US008255210B2

(12) United States Patent
Sato et al.

(10) Patent No.: US 8,255,210 B2
(45) Date of Patent: Aug. 28, 2012

(54) AUDIO/MUSIC DECODING DEVICE AND METHOD UTILIZING A FRAME ERASURE CONCEALMENT UTILIZING MULTIPLE ENCODED INFORMATION OF FRAMES ADJACENT TO THE LOST FRAME

(75) Inventors: Kaoru Sato, Kanagawa (JP); Toshiyuki Morii, Kanagawa (JP); Tomofumi Yamanashi, Tokyo (JP)

(73) Assignee: Panasonic Corporation, Osaka (JP)

( * ) Notice: Subject to any disclaimer, the term of this patent is extended or adjusted under 35 U.S.C. 154(b) by 1453 days.

(21) Appl. No.: 11/569,377

(22) PCT Filed: May 13, 2005

(86) PCT No.: PCT/JP2005/008774

§ 371 (c)(1),
(2), (4) Date: Nov. 20, 2006

(87) PCT Pub. No.: WO2005/114655

PCT Pub. Date: Dec. 1, 2005

(65) Prior Publication Data

US 2007/0271101 A1 Nov. 22, 2007

(30) Foreign Application Priority Data

May 24, 2004 (JP) ..... 2004-153997

(51) Int. Cl.
*G10L 21/02* (2006.01)
*G10L 21/00* (2006.01)
*G10L 13/00* (2006.01)

(52) U.S. Cl. ..... 704/228; 704/258

(58) Field of Classification Search ..... 704/228, 704/219, 230
See application file for complete search history.

(56) References Cited

U.S. PATENT DOCUMENTS 6,188,980 B1 * 2/2001 Thyssen ..... 704/230
(Continued)

FOREIGN PATENT DOCUMENTS

EP 1688916 8/2006
(Continued)

OTHER PUBLICATIONS

English language Abstract of JP 2003-241799, Aug. 29, 2003, and English language translation of paragraphs [0017], [0018], [0023], [0035], [0039]-[0041], and Fig. 6.

(Continued)

*Primary Examiner* — Talivaldis Ivars Smits
*Assistant Examiner* — Farzad Kazeminezhad
(74) *Attorney, Agent, or Firm* — Greenblum & Bernstein, P.L.C.

(57) ABSTRACT

An audio/music decoding device capable of improving quality of a decoded signal generated by conceal processing of a frame erase using a scalable encoding method. The audio/music decoding device includes a frame loss detector that determines whether encoded information is normally received and generates frame loss information indicating the result of the determination. According to the frame loss information, a first decoder performs decoding by using at least one of the following encoded information: the first encoded information on the frame immediately before, the first encoded information on the current frame, and the second encoded information on the current frame. According to the frame loss information, a second decoder performs decoding by using at least one of the following encoded information: the first encoded information on the frame immediately before, the first encoded information on the current frame, the second encoded information on the frame immediately before, and the second encoded information on the current frame. An adder adds the decoded signal outputted from the first decoder and the decoded signal outputted from the second decoder.

6 Claims, 14 Drawing Sheets

U.S. PATENT DOCUMENTS

| | | | | |
|---|---|---|---|---|
| 6,330,534 | B1 | 12/2001 | Yasunaga et al. | |
| 6,345,247 | B1 | 2/2002 | Yasunaga et al. | |
| 6,408,267 | B1 * | 6/2002 | Proust | 704/210 |
| 6,415,254 | B1 | 7/2002 | Yasunaga et al. | |
| 6,584,438 | B1 * | 6/2003 | Manjunath et al. | 704/228 |
| 6,757,650 | B2 | 6/2004 | Yasunaga et al. | |
| 6,775,649 | B1 * | 8/2004 | DeMartin | 704/201 |
| 6,910,008 | B1 | 6/2005 | Yasunaga et al. | |
| 6,996,522 | B2 * | 2/2006 | Chen | 704/219 |
| 7,024,356 | B2 | 4/2006 | Yasunaga et al. | |
| 7,110,943 | B1 | 9/2006 | Morii et al. | |
| 7,590,525 | B2 * | 9/2009 | Chen | 704/211 |
| 2006/0178872 | A1 | 8/2006 | Sung et al. | |

FOREIGN PATENT DOCUMENTS

| | | |
|---|---|---|
| EP | 1785984 | 5/2007 |
| EP | 1793373 | 6/2007 |
| JP | 10-97295 | 4/1998 |
| JP | 2002-268696 | 9/2002 |

OTHER PUBLICATIONS

Ramprashad, "High quality embedded wideband speech coding using an inherently layered coding paradigm", Acoustics, Speech, and Signal Processing, 2000. ICASSP '00. Proceedings. 2000 IEEE International Conference on Jun. 5-9, 2000, Piscataway, NJ, USA, IEEE, vol. 2, Jun. 5, 2000, pp. 1145-1148; XP01504930.

Erdmann et al., "Pyramid CELP: embedded speech coding for packet communications", 2002 IEEE International Conference on Acoustics, Speech, and Signal Processing. Proceedings. Orlando, FL, May 13-17, 2002, IEEE International Conference on Acoustics, Speech, and Signal Processing, New York, NY: IEEE, US, vol. 4 of 4, May 13, 2002, pp. I-181 to I-184; XP010804677.

English Language abstract of JP 2002-268696.

Nomura et al., "MPEG-4/CELP Onsei Fugoka Hoshiki", The Institute of Electronics, Information and Communication Engineers Gijutsu Kenkyu Hokoku, [Onseij], vol. 98, No. 424, Nov. 20, 1998, SP98-89, pp. 19 to 26.

M.R. Schroeder et al. , "Code-Excited Linear Prediction (CELP): High-Quality Speech at Very Low Bit Rates", IEEE Proc., ICASSP '85 pp. 937-940.

English Language abstract of JP 10-97295.

* cited by examiner

| FRAME LOSS INFORMATION | 1ST ENCODED INFORMATION | 2ND ENCODED INFORMATION | PARAMETERS USED BY 1ST DECODING SECTION 153 | | PARAMETERS USED BY 2ND DECODING SECTION 154 | |
|---|---|---|---|---|---|---|
| 3 | RECEIVED CORRECTLY | RECEIVED CORRECTLY | LSP DECODING SECTION | lsp | LSP DECODING SECTION | lsp.d_lsp |
| | | | ADAPTIVE EXCITATION CODEBOOK | lag | ADAPTIVE EXCITATION CODEBOOK | lag.d_lag |
| | | | FIXED EXCITATION CODEBOOK | sc | FIXED EXCITATION CODEBOOK | e_sc |
| | | | QUANTIZED GAIN GENERATING SECTION | ga.gs | QUANTIZED GAIN GENERATING SECTION | e_ga.e_gs |
| 2 | LOSS | RECEIVED CORRECTLY | LSP DECODING SECTION | p_lsp.d_lsp | LSP DECODING SECTION | p_lsp.d_lsp |
| | | | ADAPTIVE EXCITATION CODEBOOK | p_lag.d_lag | ADAPTIVE EXCITATION CODEBOOK | p_lag.d_lag |
| | | | FIXED EXCITATION CODEBOOK | p_sc | FIXED EXCITATION CODEBOOK | e_sc |
| | | | QUANTIZED GAIN GENERATING SECTION | p_ra.p_gs.e_ga.e_gs | QUANTIZED GAIN GENERATING SECTION | e_ga.e_gs |
| 1 | RECEIVED CORRECTLY | LOSS | LSP DECODING SECTION | lsp | LSP DECODING SECTION | lsp.p_d_lsp |
| | | | ADAPTIVE EXCITATION CODEBOOK | lag | ADAPTIVE EXCITATION CODEBOOK | lag.p_d_lag |
| | | | FIXED EXCITATION CODEBOOK | ac | FIXED EXCITATION CODEBOOK | p_e_sc |
| | | | QUANTIZED GAIN GENERATING SECTION | ga.ga | QUANTIZED GAIN GENERATING SECTION | ga.gs.p_e_ga.p_e_gs |
| 0 | LOSS | LOSS | LSP DECODING SECTION | p_lsp | LSP DECODING SECTION | p_lsp.p_d_lsp |
| | | | ADAPTIVE EXCITATION CODEBOOK | p_lap | ADAPTIVE EXCITATION CODEBOOK | p_lag.p_d_lag |
| | | | FIXED EXCITATION CODEBOOK | p_sc | FIXED EXCITATION CODEBOOK | p_e_sc |
| | | | QUANTIZED GAIN GENERATING SECTION | p_ga.p_gs | QUANTIZED GAIN GENERATING SECTION | p_e_ga.p_e_gs |

FIG.12

AUDIO/MUSIC DECODING DEVICE AND METHOD UTILIZING A FRAME ERASURE CONCEALMENT UTILIZING MULTIPLE ENCODED INFORMATION OF FRAMES ADJACENT TO THE LOST FRAME

TECHNICAL FIELD

The present invention relates to a speech/sound decoding apparatus and a speech/sound decoding method for use in a communication system in which speech/sound signals are encoded and transmitted.

BACKGROUND ART

In the field of digital wireless communication, packet communication typified by Internet communication, or speech storage, speech signal encoding and decoding techniques are essential for effective use of the capacity of transmission paths of radio wave and storage media, and many speech encoding/decoding schemes have so far been developed. Among these, a CELP speech encoding and decoding scheme is put in practical use as a mainstream scheme (for example, see non-patent document 1).

The speech encoding apparatus of the CELP scheme encodes input speech based on pre-stored speech models. Specifically, a digital speech signal is separated into frames of approximately 10-20 ms, linear prediction analysis of speech signals is performed per frame, linear prediction coefficients and linear prediction residual vectors are obtained, and the linear prediction coefficients and linear prediction residual vectors are encoded individually. To carry out low bit rate communication, the amount of speech models that can be stored is limited, and therefore speech models are mainly stored in conventional CELP type speech encoding and decoding schemes In communication systems where packets are transmitted, such as Internet communication, packet loss may occur depending on the network state, and it is thus desirable that, even if part of encoded information is lost, speech and sound can be decoded using the remaining part of encoded information. Similarly, in variable rate communication systems in which a bit rate varies depending on communication capacity, it is desirable that, when the communication capacity decreases, the burden on communication capacities is easy to reduce by transmitting a part of encoded information. As a technique capable of decoding speech/sound using all or part of encoded information in this way, a scalable coding technique has lately attracted attention. Several scalable coding schemes have been conventionally disclosed (for example, see patent document 1).

A scalable encoding scheme generally consists of a base layer and a plurality of enhancement layers, and these layers form a hierarchical structure in which the base layer is the lowest layer. At each layer, encoding of a residual signal that is a difference between input signal and output signal of the lower layer is performed. This configuration enables speech and sound decoding using encoded information at all layers or only encoded information at lower layers.

In the communication system transmitting the packet, when the decoding apparatus side cannot receive encoded information due to packet loss or the like, deterioration of decoded speech signals can be prevented to some degree by performing loss compensation (concealing). A method of concealing frame elimination is prescribed as a part of a decoding algorithm in, for example, ITU-T recommendation G.729.

Generally, loss compensation (concealing) processing recovers the current frame based on encoded information contained in a previously received frame. Decoded speech signals of the lost frame are produced by, for example, using encoded information contained in the frame immediately preceding the lost frame as encoded information for the lost frame; and gradually attenuating the energy of decoded signals which are generated using encoded information contained in the immediately preceding frame.

Patent Document 1: Japanese Patent Application Laid-Open No. Hei 10-97295

Non-patent Document 1: M. R. Schroeder, B. S. Atal, "Code Excited Linear Prediction: High Quality Speech at Low Bit Rate", IEEE proc., ICASSP'85 pp. 937-940

DISCLOSURE OF INVENTION

Problems to be Solved by the Invention

However, conventional loss compensation (concealing) processing only recovers decoded speech signals using encoded information contained in the frame immediately preceding the lost frame and, although deterioration of encoded speech signals may be prevented to some degree, the quality of the decoded speech signals is not sufficient. In the scalable encoding scheme, generally, the base layer encoded information is of high importance and, if the base layer encoded information is lost due to frame loss, it is impossible to obtain decoded speech signals with sufficient quality only by recovering the decoded speech signals using the encoded information contained in the immediately preceding frame.

It is therefore an object of the present invention to provide a speech/sound decoding apparatus and a speech/sound decoding method capable of obtaining decoded speech signals with sufficient quality, even if encoded information is lost due to a frame loss occurring in a scalable encoding scheme.

Means for Solving the Problem

A speech/sound decoding apparatus of the present invention is a speech/sound decoding apparatus that generates decoded signals by decoding encoded information encoded by scalable encoding and configured in a plurality of layers, adopts a configuration having: a frame loss detecting section that determines whether or not encoded information in each of the layers in a received frame is correct, and generates frame loss information that is a result of the determination; and decoding sections that are provided in the same number as the layers and that each determine encoded information to be used for decoding of each layer from the received encoded information and a plurality of previously received encoded information, according to the frame loss information, and generates decoded signals by performing decoding using the determined encoded information.

A speech/sound decoding method of the present invention is a speech/sound decoding method for generating decoded signals by decoding encoded information encoded by scalable encoding and configured in a plurality of layers, the speech/sound decoding method, having: a frame loss detection step of determining whether or not encoded information in each of the layers in a received frame is correct and generating frame loss information that is a result of the determination; and a decoding step, performed the same number of times as the number of the layers, of determining encoded information to be used for decoding in each layer from the received encoded information and a plurality of previously received encoded information, according to the frame loss information, and generating decoded signals by performing decoding using the determined encoded information.

Advantageous Effect of the Invention

According to the present invention, it is possible to improve decoded speech signal quality by obtaining decoded signals using encoded information obtained by another encoding section in addition to previously received encoded information, as compared with the case of using only the previously received encoded information.

BRIEF DESCRIPTION OF DRAWINGS

FIG. 12 shows a table listing frame loss information and parameters to be used by decoding sections according to Embodiment 1 of the present invention;

BEST MODE FOR CARRYING OUT THE INVENTION

A gist of the present invention is to improve the quality of decoded speech signals with a scalable encoding scheme utilizing a plurality of encoding sections, by outputting encoded information from each encoding section and transmitting the information to a decoding apparatus side, determining at the decoding apparatus side, whether encoded information is transmitted without loss, and, if a loss of encoded information is detected, performing decoding using encoded information outputted from another encoding section in addition to encoded information contained in a frame immediately preceding the lost frame.

Embodiments of the present invention will be described in detail below with reference to the accompanying drawings. Examples will be described where speech/sound encoding and decoding are performed according to the CELP scheme.

Embodiment 1

Figure 1:
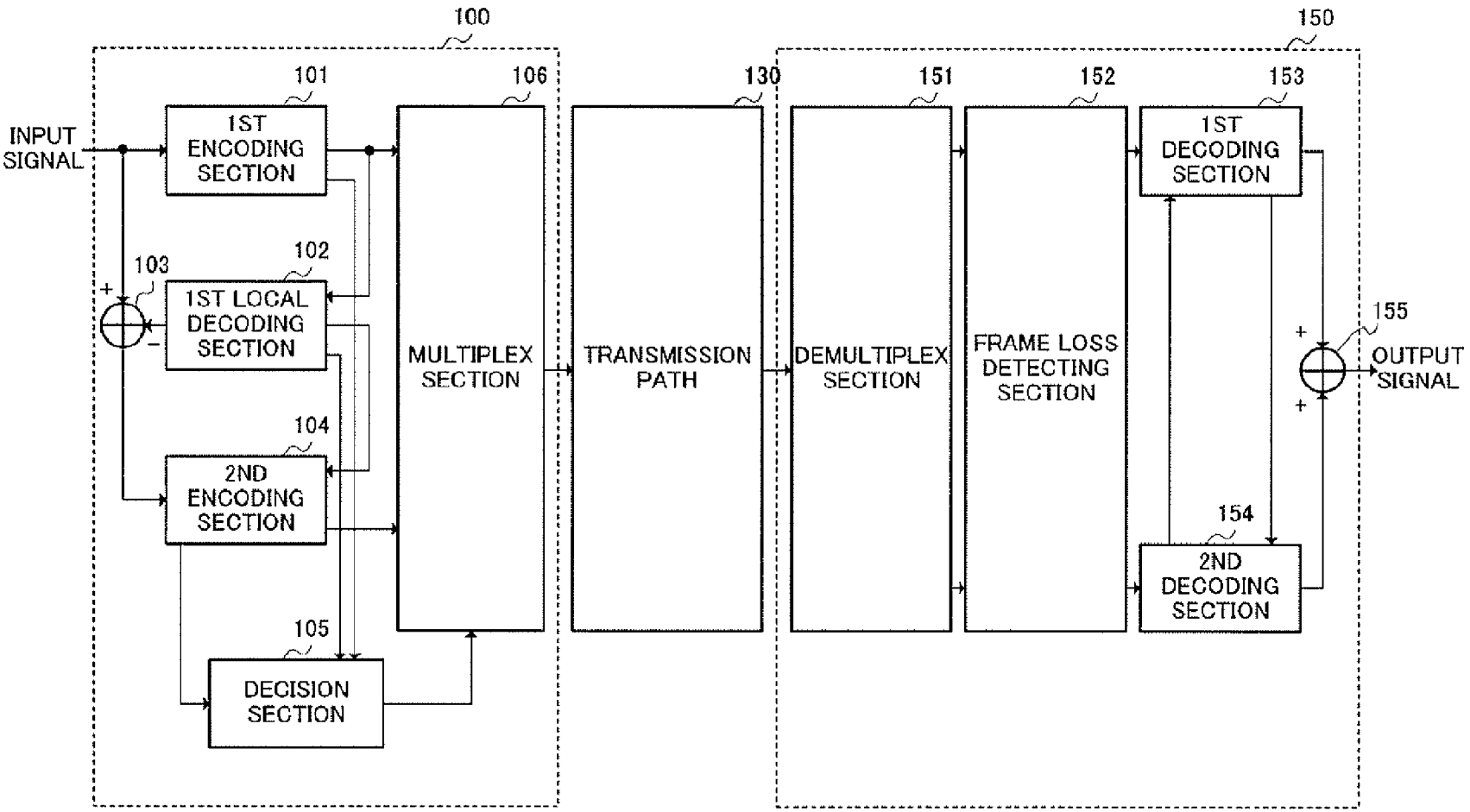
FIG. 1 is a block diagram showing the configurations of an encoding apparatus and a decoding apparatus according to Embodiment 1 of the present invention.

FIG. 1 is a block diagram showing the main apparatus 150 according to Embodiment 1 of the present invention.

Encoding apparatus 100 is mainly configured with first encoding section 101, first local decoding section 102, adder 103, second encoding section 104, decision section 105 and multiplex section 106. Decoding apparatus 150 is mainly configured with demultiplex section 151, frame loss detecting section 152, first decoding section 153, second decoding section 154 and adder 155. Encoded information outputted from encoding apparatus 100 is transmitted to decoding apparatus 150 via transmission path 130.

The processing of each section of encoding apparatus 100 will be described blow. Speech/sound signals that are input signals are inputted to first encoding section 101 and adder 103.

First encoding section 101 obtains first encoded information from an inputted speech/sound signal using the speech/sound encoding method of the CELP scheme, and outputs the first encoded information to first local decoding section 102 and multiplex section 106.

First local decoding section 102 decodes the first encoded information outputted from first encoding section 101 into a first decoded signal using the speech/sound decoding method of the CELP scheme, and outputs the decoded signal obtained by this decoding to adder 103.

Adder 103 reverses the polarity of the first decoded signal outputted from first local decoding section 102 and adds this signal to an inputted speech/sound signal, and outputs a residual signal resulting from the addition to second encoding section 104.

Second encoding section 104 obtains second encoded information from the residual signal outputted from adder 103 using the speech/sound decoding method of the CELP scheme, and outputs the second encoded information to multiplex section 106.

Decision section 105 generates flag information by a method which will be described later and outputs this flag information to multiplex section 106. Here, the "flag information" refers to information indicating whether, if first encoded information loss is detected at decoding apparatus 150, first decoding section 153 should include second encoded information as encoded information to be used for decoding. As the flag information, a value of "0" or "1" is used here. When the flag information is "0", first decoding section 153 performs decoding using only first encoded information in the preceding frame. When the flag information is "1", first decoding section 153 performs decoding using the first encoded information in the preceding frame and the second encoded information.

Multiplex section 106 multiplexes first encoded information outputted from first encoding section 101, second encoded information outputted from second encoding section 104, and flag information outputted from decision section 105, and outputs multiplex information to transmission path 130.

It is assumed in the present description that encoding apparatus 100 performs speech/sound signal encoding on a per frame basis, stores first encoded information and second encoded information in one frame in respective packets, and transmits these packets. In one framer thus, there are two packets: a packet containing first encoded information and a packet containing second encoded information. For each frame, these two packets are transmitted to decoding apparatus 150. When a packet loss occurs, at least one of the first encoded information and the second encoded information is lost.

Then, processing of each section of decoding apparatus 150 will be described. Demultiplex section 151 demultiplexes multiplex information transmitted from encoding apparatus 100 into first encoded information, second encoded information and flag information, and outputs the first and second encoded information to frame loss detecting section 152 and the flag information to first decoding section 153.

Frame loss detecting section 152 determines whether the first and second encoded information outputted from demultiplex section 151 is received correctly and generates frame loss information indicating the determination result. As a method for detecting frame loss, for example, a method of monitoring identification information attached to packets is known. The receiving side monitors identification information attached to a packet such as, for example, the sequence number of the packet (packet number), the time stamp indicating the time the packet was generated, and detects the packet loss by detecting discontinuity of such identification information. As the identification information, for example, communication protocol TCP/IP sequence numbers, UDP/IP sequence numbers, time stamp information may be used.

As the frame loss information, values of "0" to "3" are used here. The frame loss information assumes a value of "0", if neither the first encoded information nor the second encoded information is received correctly; a value of "1", if the first encoded information is received correctly, but the second code is not received correctly; a value of "2", if the second encoded information is received correctly, but the first encoded information is not received correctly; and a value of "3", if both the first encoded information and the second encoded information are received correctly. Then, frame loss detecting section 152 outputs the frame loss information to first decoding section 153 and second decoding section 154. Next, frame loss detecting section 152 outputs correctly received encoded information to the corresponding decoding section. Specifically, frame loss detecting section 152 outputs the first encoded information to first decoding section 153, if the frame loss information is "1" or "3", (when the first encoded information is received correctly), and outputs the second encoded information to second decoding section 154, if the frame loss information is "2" or "3" (when the second encoded information is received correctly).

First decoding section 153 receives the flag information from demultiplex section 151 and receives the frame loss information from frame loss detecting section 152. Also, first decoding section 153 is provided with a buffer inside for storing first encoded information in the immediately preceding frame and may use the first encoded information in the immediately preceding frame stored in the buffer for decoding, if the first encoded information in the current frame is not received correctly.

Then, first decoding section 153 refers to the frame loss information. If the frame loss information is "1" or "3" (when the first encoded information is received correctly), first decoding section 153 receives the first encoded information from frame loss detecting section 152 and decodes the first encoded information using the speech/sound decoding method of the CELP scheme. If the frame loss information is "D", first decoding section 153 decodes the first encoded information in the immediately preceding frame using the speech/sound decoding method of the CELP scheme. If the frame loss information is "2", first decoding section 153 receives the second encoded information and decodes encoded information obtained from the second encoded information and the first encoded information in the immediately preceding frame using the speech/sound decoding method of the CELP scheme. However, first decoding section 153 does not use the second encoded information, if the flag information is "0".

In this embodiment, the first encoded information is decoded, if the first encoded information is received correctly, and the first encoded information included in the immediately preceding frame is decoded, if the first encoded information is not received correctly. In this embodiment, it is intended to further improve the decoded signal quality using the second encoded information in addition to the first encoded information included in the immediately preceding frame, if the first encoded information is not received correctly.

Then, first decoding section 153 outputs a first decoded signal obtained by decoding to adder 155. Also, first decoding section 153 outputs the first encoded information to second decoding section 154, if the frame loss information is "1" or "3". Also, first decoding section 153 outputs the first encoded information in the immediately preceding frame to second decoding section 154, if the frame loss information is "0" or "2".

A specific method of decoding encoded information by first decoding section 153 will be described later.

Second decoding section 154 receives the frame loss information from frame loss detecting section 152. Also, second decoding section 154 is provided with a buffer inside for storing second encoded information in the immediately preceding frame and may use the second encoded information in the immediately preceding frame stored in the buffer for decoding, if the second encoded information in the current frame is not received correctly.

Then, second decoding section 154 refers to the frame loss information. If the frame loss information is "3", second decoding section 154 receives the second encoded information from frame loss detecting section 152 and decodes the second encoded information using the speech/sound decoding method of the CELP scheme. If the frame loss information is "2", second decoding section 154 receives the second encoded information from frame loss detecting section 152, receives the first encoded information in the immediately preceding frame from first decoding section 153, and decodes encoded information obtained from the second encoded information and the first encoded information in the immediately preceding frame using the speech/sound decoding method of the CELP scheme. If the frame loss information is "1", second decoding section 154 receives the first encoded information from first decoding section 153 and decodes encoded information obtained from the first encoded information and the second encoded information in the immediately preceding frame using the speech/sound decoding method of the CELP scheme. If the frame loss information is "0" second decoding section 154 receives the first encoded information in the immediately preceding frame from first decoding section 153 and decodes encoded information obtained from the first encoded information in the immediately preceding frame and the second encoded information in the immediately preceding frame using the speech/sound decoding method of the CELP scheme.

As described above, second decoding section 154 performs decoding using the second encoded information and the first encoded information or the first encoded information in the immediately preceding frame, if the second encoded information is received correctly, and performs decoding using the second encoded information in the immediately preceding frame and the first encoded information or the first encoded information in the immediately preceding frame, if the second encoded information is not received correctly.

Then, second decoding section 154 outputs a second decoded signal obtained by decoding to adder 155. Also, second decoding section 154 outputs the second encoded information to first decoding section 153, if the frame loss information is "2".

A specific method of decoding encoded information by second decoding section 154 will be described later.

Adder 155 receives the first decoded signal from first decoding section 153 and the second decoded signal from second decoding section 154, adds the first decoded signal and the second decoded signal, and output a decoded signal resulting from the addition as an output signal.

Figure 2:
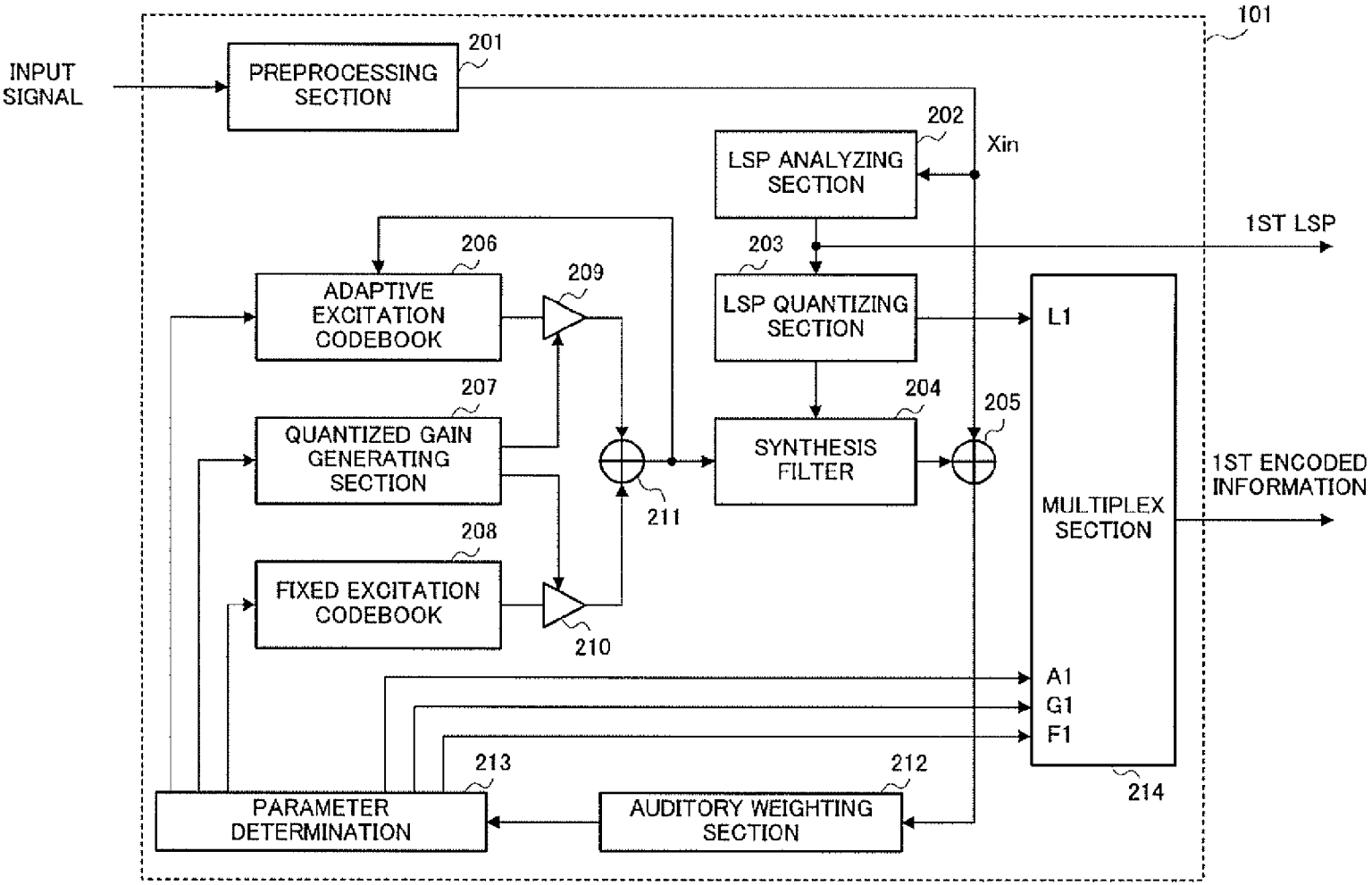
FIG. 2 is a block diagram showing an internal configuration of a first encoding section according to Embodiment 1 of the present invention.

Next, an internal configuration of first encoding section 101 of encoding apparatus 100 will be described. FIG. 2 is a block diagram showing the internal configuration of first encoding section 101. First encoding section 101 separates an inputted speech/sound signal per N samples (N is a natural number) and performs encoding per frame.

Input signals for first encoding section 101 are inputted to preprocessing section 201. Preprocessing section 201 performs high-pass filtering processing for removing a DC component, waveform shaping processing which helps to improve the performance of subsequent encoding processing, and pre-emphasizing processing, and outputs the processed signals (Xin) to LSP analyzing section 202 and adder 205.

LSP analyzing section 202 performs linear prediction analysis using the Xin, converts LPC (Linear Prediction Coefficients) resulting from the analysis into LSP (Line Spectral Pairs), and outputs the conversion result as a first LSP to LSP quantizing section 203 and decision section 105.

LSP quantizing section 203 quantizes the first LSP outputted from LSP analyzing section 202 and outputs the quantized first LSP (first quantized LSP) to synthesis filter 204. Also, LSP quantizing section 203 outputs a first quantized LSP code (L1) indicating the first quantized LSP to multiplex section 214.

Synthesis filter 204 performs filter synthesis of a driving excitation, outputted from adder 211 which will be described later, by a filter coefficient based on the first quantized LSP, and thereby generates a synthesis signal, and outputs the synthesis signal to adder 205.

Adder 205 reverses the polarity of the synthesis signal, adds this signal to Xin, thereby calculating an error signal, and outputs the error signal to auditory weighting section 212.

Adaptive excitation codebook 206 has a buffer storing driving excitations which have so far been outputted by adder 211, extracts a set of samples for one frame from the buffer at an extraction position specified by a signal outputted from parameter determination section 213, and outputs the sample set as a first adaptive excitation vector to multiplier 269. Also, adaptive excitation codebook 206 updates the buffer, each time a driving excitation is inputted from adder 211.

Quantized gain generating section 207 determines a first quantized adaptive excitation gain and a first quantized fixed excitation gain, according to a signal outputted from parameter determination section 213, and outputs these gains to multiplier 209 and multiplier 210, respectively.

Fixed excitation codebook 208 outputs a vector having a form that is determined by a signal outputted from parameter determination section 213 as a first fixed excitation vector to multiplier 210.

Multiplier 209 multiples the first quantized adaptive excitation gain outputted from quantized gain generating section 207 by the first adaptive excitation vector outputted from adaptive excitation codebook 206 and outputs the result to adder 211. Multiplier 210 multiples the first quantized fixed excitation gain outputted from quantized gain generating section 207 by the first fixed excitation vector outputted from fixed excitation codebook 208 and outputs the result to adder 211.

Adder 211 receives the first adaptive excitation vector and the first fixed excitation vector which were both multiplied by the respective gains from multiplier 209 and multiplier 210, respectively, adds the first adaptive excitation vector and the first fixed excitation vector multiplied by the respective gains, and outputs a driving excitation resulting from the addition to synthesis filter 204 and adaptive excitation codebook 206. The driving excitation inputted to adaptive excitation codebook 206 is stored into the buffer.

Auditory weighting section 212 applies an auditory weight to the error signal outputted from adder 205 and outputs a result as a coding distortion to parameter determination section 213.

Parameter determination section 213 selects a first adaptive excitation lag that minimizes the coding distortion outputted from auditory weighting section 212 from adaptive excitation codebook 206 and outputs a first adaptive excitation lag code (A1) indicating a selected lag to multiplex section 214. Here, the "first adaptive excitation lag" is an extraction position where the first adaptive excitation vector is extracted, and its detailed description will be provided later. Also, parameter determination section 213 selects a first fixed excitation vector that minimizes the coding distortion outputted from auditory weighting section 212 from fixed excitation codebook 208 and outputs a first fixed excitation vector code (F1) indicating a selected vector to multiplex section 214. Furthermore, parameter determination section 213 selects a first quantized adaptive excitation gain and a first quantized fixed excitation gain that minimize the coding distortion outputted from auditory weighting section 212 from quantized gain generating section 207 and outputs a first quantized excitation gain code (G1) indicating selected gains to multiplex section 214.

Multiplex section 214 receives the first quantized LSP code (L1) from LSP quantizing section 203 and receives the first adaptive excitation lag code (A1), the first fixed excitation vector code (F1) and the first quantized excitation gain code (G1) from parameter determination section 213, multiplexes these information, and outputs the result as the first encoded information.

Next, processing in which LSP quantizing section 203 determines the first quantized LSP will be outlined, taking an example where the number of bits assigned to the first quantized LSP code (L1) is "8".

LSP quantizing section 203 is provided with a first LSP codebook in which 256 variants of first LSP code vectors $lsp_1^{(l1)}$ (i) which are created in advance are stored. Here, l1 is an index attached to the first LSP code vectors, taking a value from 0 to 255. The first LSP code vectors $lsp_1^{(l1)}$ (i) are N-dimensional vectors with i taking a value from 0 to N−1. ESP quantizing section 203 receives the first LSPα(i) outputted from LSP analyzing section 202. Here, the first LSPα(i) is N-dimensional vectors.

Then, LSP quantizing section 203 obtains squared error $er_1$ between the first LSPα(i) and the first ESP code vector $lsp_1^{(l1)}$ (i) by equation (1)

$$er_1 = \sum_{i=0}^{N-1} \left(\alpha_1(i) - lsp_1^{(f1)}(i)\right)^2 \quad (1)$$

After obtaining squared errors $er_1$ for all l1 indexes, LSP quantizing section 203 then determines a value of l1 that minimizes squared error $er_1$ ($l1_{min}$). Then, LSP quantizing section 203 outputs $l1_{min}$ as the first quantized LSP code (L1) to multiplex section 214 and outputs $lsp_1^{(l1min)}$ (i) as the first quantized LSP to synthesis filter 204.

$lsp_1^{(l1min)}$ (i) obtained by LSP quantizing section 203, is the "first quantized LSP".

Figure 3:
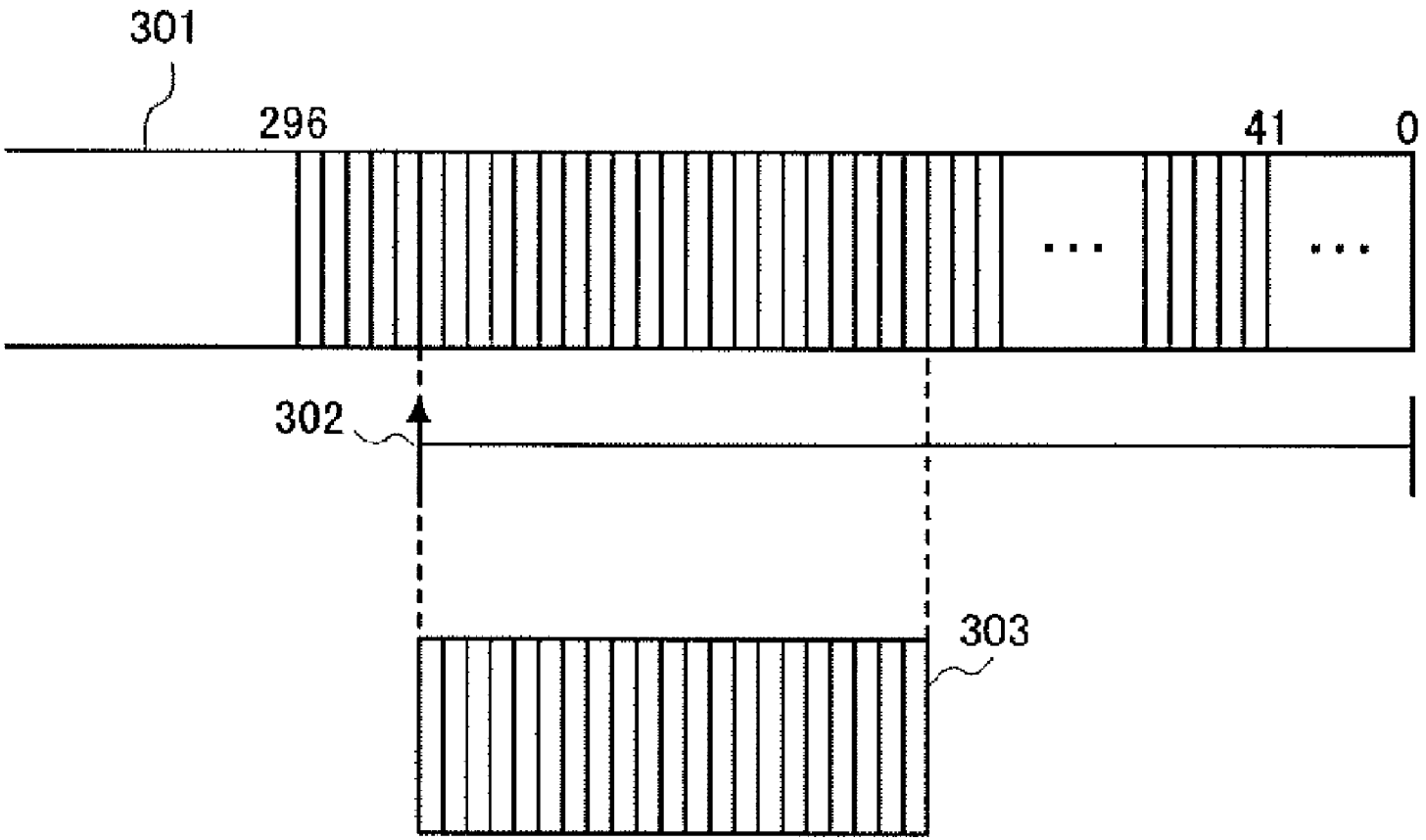
FIG. 3 illustrates processing for determining an adaptive excitation lag.

Next, processing in which parameter determination section 213 determines the first adaptive excitation lag will be described using FIG. 3. In FIG. 3, buffer 301 is the buffer provided by adaptive excitation codebook 206, position 302 is a first adaptive excitation vector extraction position, vector 303 is an extracted first adaptive excitation vector. Values "41" and "296" correspond to lower and upper limits of the range of shifting extraction position 302.

Assuming that the number of bits assigned no the code (A1) indicating the first adaptive excitation lag is "8", the range of shifting extraction position 302 can be set in a range of length of "256" (For example, 41 to 296). Additionally, the range of shifting extraction position 302 can be arbitrarily set.

Parameter determination section 213 shifts extraction position 302 within the set range and sequentially indicates extraction position 302 to adaptive excitation codebook 206. Then, adaptive excitation codebook 206 extracts first adaptive excitation vector 303 with a length of the frame by extraction position 302 indicated by parameter determination section 213 and outputs the extracted first adaptive excitation vector to multiplier 209. Then, parameter determination section 213 obtains the coding distortion which is outputted from auditory weighting section 212 for the case of extracting first adaptive excitation vectors 303 at all extraction positions 302, and determines extraction position 302 that minimizes the coding distortion.

Extraction position 302 from the buffer obtained by parameter determination section 213, is the "first adaptive excitation lag".

Then, parameter determination section 213 outputs the first adaptive excitation lag code (A1) indicating the first adaptive excitation lag that minimizes the coding distortion to multiplex section 214.

Next, processing in which parameter determination section 213 determines the first fixed excitation vector will be described using FIG. 4. Here, this will be explained, taking an example where "12" bits are assigned to the first fixed excitation vector code (F1).

Figure 4:
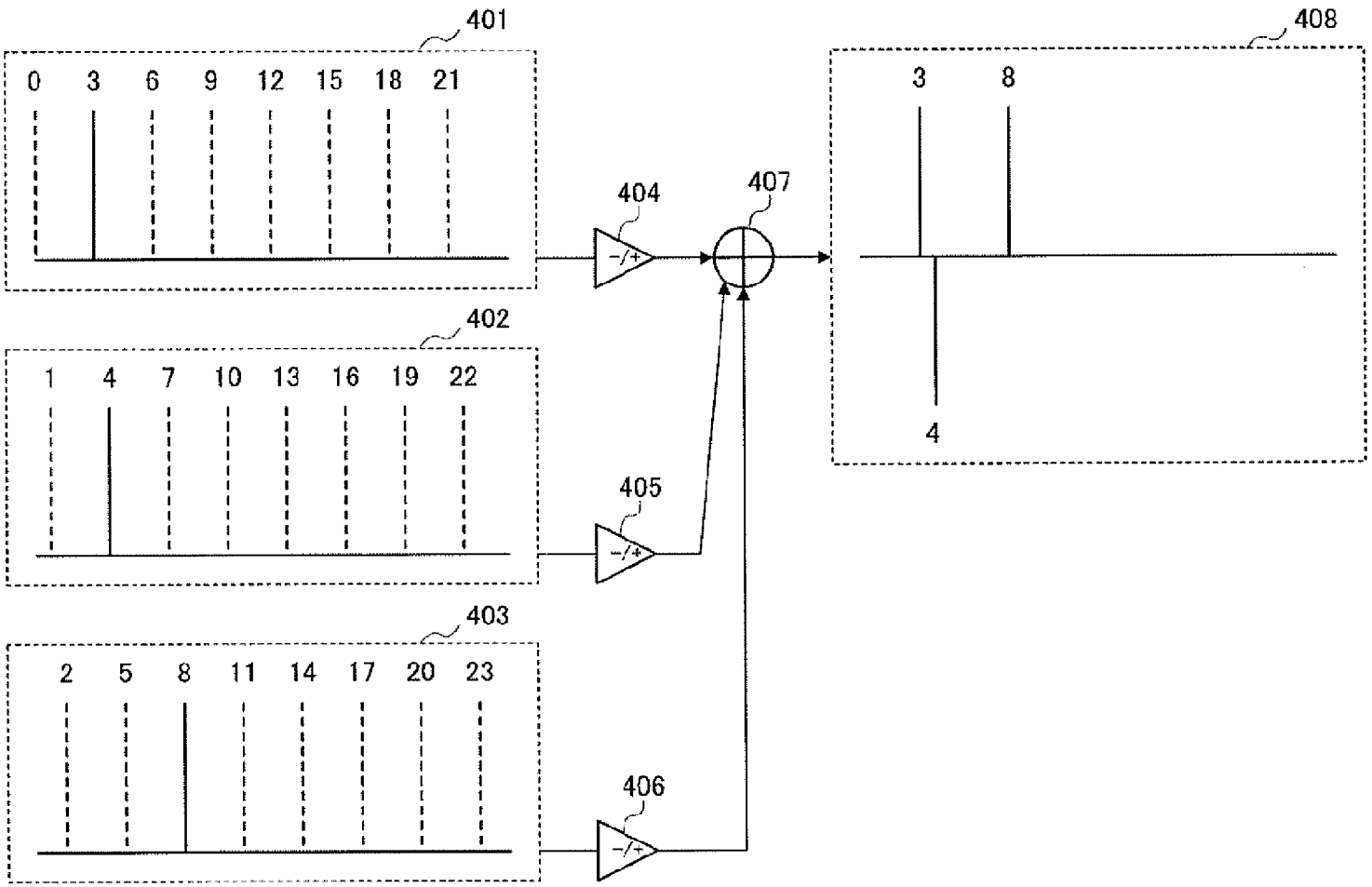
FIG. 4 illustrates processing for determining a fixed excitation vector.

In FIG. 4, tracks 401, 402 and 903 each generate one unit pulse (with an amplitude value of 1). Multipliers 404, 405 and 406 assign polarity to the unit pluses generated by tracks 401, 402 and 403. Adder 407 adds the generated three unit pulses, and vector 408 is a "first fixed excitation vector" consisting of the three unit pulses.

Each track has different positions where a unit pulse can be generated. In FIG. 4, the tracks are configured such that track 401 raises a unit pulse at one of eight positions {0, 3, 6, 9, 12, 15, 18, 21}, track 402 raises a unit pulse at one of eight positions {1, 4, 7, 10, 13, 16, 19, 22}, and track 403 raises a unit pulse at any of eight positions {2, 5, 8, 11, 14, 17, 20, 23}.

Then, polarity is assigned to the generated unit pulses by multi-pliers 404, 405 and 406, respectively, the three unit pulses are added by adder 407, and first fixed excitation vector 408 resulting from the addition is formed.

In the example of FIG. 4, unit pulse has eight patterns of positions and two patterns of positions, positive and negative, and three bits for position information and one bit for polarity information are used to represent each unit pulse. Therefore, the fixed excitation codebook has 12 bits in total. Parameter determination section 213 shifts the positions of the three unit pulses and changes their polarity, and sequentially indicates the pulse positions and polarity to fixed excitation codebook 208. Then, fixed excitation codebook 208 configures first fixed excitation vectors 408 using the generation positions and polarity indicated by parameter determination section 213 and outputs the configured first fixed excitation vectors 408 to multiplier 210. Then, parameter determination section 213 obtains the coding distortion which is outputted from auditory weighting section 212 with regard to all combinations of the generation positions and polarity and determines a combination of the generation positions and polarity that minimizes the coding distortion. Then, parameter determination section 213 outputs the first fixed excitation vector code (F1) indicating the combination of the pulse positions and polarity that minimizes the coding distortion to multiplex section 214.

Next, processing in which parameter determination section 213 determines a first quantized adaptive excitation gain and a first quantized fixed excitation gain which are generated from quantized gain generating section 207, taking an example where "8" bits are assigned to the first quantized excitation gain code (G1). Quantized gain generating section 207 is provided with a first excitation gain codebook in which 256 variants of first excitation gain code vectors $gain_1^{(k1)}$ (i) which are created in advance are stored. Here, k1 is an index attached to the first excitation gain code vectors, taking a value from 0 to 255. The first excitation gain code vectors $gain_1^{(k1)}$ (i) are two-dimensional vectors with i taking a value from 0 to 1. Parameter determination section 213 sequentially indicates a value of k1 from 0 to 255 to quantized gain generating section 207. Quantized gain generating section 207 selects a first excitation gain code vector $gain_1^{(k1)}$ (i) from the first excitation gain codebooks using k1 indicated by parameter determination section 213 and outputs $gain_1^{(k1)}$ (i) as the first quantized adaptive excitation gain to multiplier 209 and $gain_1^{(k1)}$ (1) as the first quantized fixed excitation gain to multiplier 210.

$gain_1^{(k1)}$ (0) and $gain_1^{(k1)}$ (1), obtained by quantized gain generating section 207, are "first quantized adaptive excitation gain" and "first quantized fixed excitation gain". Parameter determination section 213 obtains the coding distortion which is outputted from auditory weighting section 212 with regard to all k1 indexes and determines a value of k1 ($k1_{min}$) that minimizes the coding distortion. Then, parameter determination section 213 outputs $k1_{min}$ as the first quantized excitation gain code (G1) to multiplex section 214.

Figure 5:
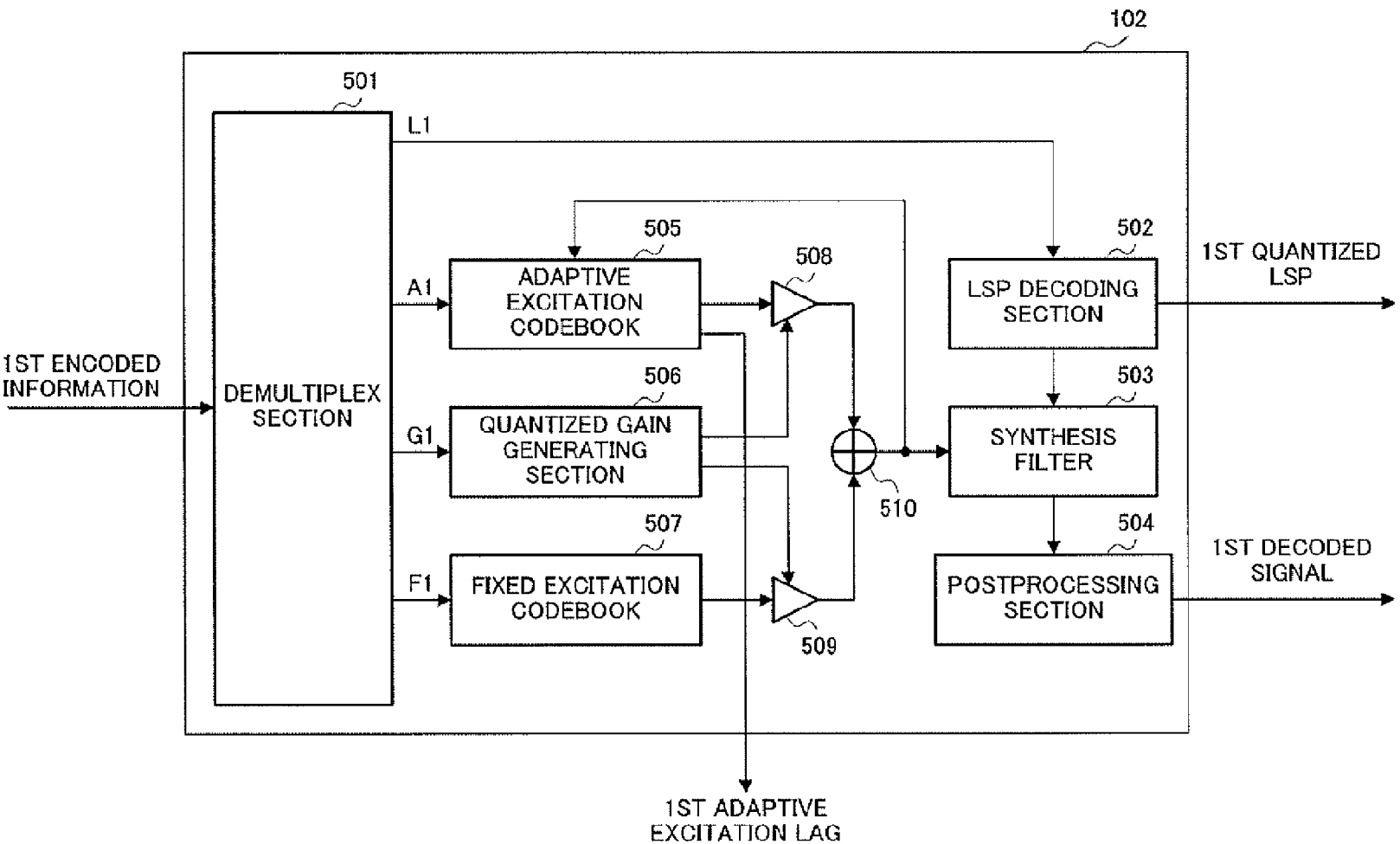
FIG. 5 is a block diagram showing an internal configuration of a first local decoding section according to Embodiment 1 of the present invention.

Next, an internal configuration of first local decoding section 102 will be described, using the block diagram shown in FIG. 5. In FIG. 5, first encoded information inputted to first local decoding section 102 is demuitiplexed into individual codes (L1, A1, G1, and F1) by demultiplex section 501. The divided first quantized LSP code (L1) is outputted to LSP decoding section 502; the divided first adaptive excitation lag code (A1) is outputted to adaptive excitation codebook 505; the divided first quantized excitation gain code (G1) is outputted to quantized gain generating section 506; and the divided first fixed excitation vector code (F1) is outputted to fixed excitation codebook 507.

LSP decoding section 502 decodes the first quantized LSP code (L1) outputted from demultiplex section 501 into the first quantized LSP and outputs the decoded first quantized LSP to synthesis filter 503, second decoding section 104, and decision section 105.

Adaptive excitation codebook 505 extracts samples for one frame from its buffer at an extract-on position specified by the first adaptive excitation lag code (A1) outputted from demultiplex section 501 and outputs the extracted vector as the first adaptive excitation vector to multiplier 508. Also, adaptive excitation codebook 505 outputs the extraction position specified by the first adaptive excitation lag code (A1) as the first adaptive excitation lag to second decoding section 104. Furthermore, adaptive excitation codebook 505 updates the buffer each time a driving excitation is inputted thereto from adder 510.

Quantized gain generating section 506 decodes the first quantized adaptive excitation gain and the first quantized fixed excitation gain which are specified by the first quantized excitation gain code (G1) outputted from demultiplex section 501 and outputs the first quantized adaptive excitation gain to multiplier 500 and the first quantized fixed excitation gain to multiplier 509.

Fixed excitation codebook 507 generates the first fixed excitation vector which is specified by the first fixed excitation vector code (F1) outputted from demultiplex section 501 and outputs the result to multiplier 509.

Multiplier 508 multiplies the first adaptive is excitation vector by the first quantized adaptive excitation gain and outputs the result to adder 510. Multiplier 509 multiples the first fixed excitation vector by the first quantized fixed excitation gain and outputs the result to adder 510.

Adder 510 adds the first adaptive excitation vector and the first fixed excitation vector multiplied by the respective gains outputted from multipliers 508 and 509, generates a driving excitation, and outputs the driving excitation to synthesis filter 503 and adaptive excitation codebook 505. The driving excitation inputted to adaptive excitation codebook 505 is stored into the buffer.

Synthesis filter 503 performs filter synthesis on the driving excitation outputted from adder 510 with the filter coefficient decoded by LSP decoding section 502 and outputs a synthesis signal to postprocessing section 504.

Postprocessing section 504 processes the synthesis signal outputted from synthesis filter 503 by performing processing for improving a subjective speech quality, such as format emphasizing and pitch emphasizing, and by performing processing for improving a subjective stationary noise quality, and outputs the processed signal as a first decoded signal.

Figure 6:
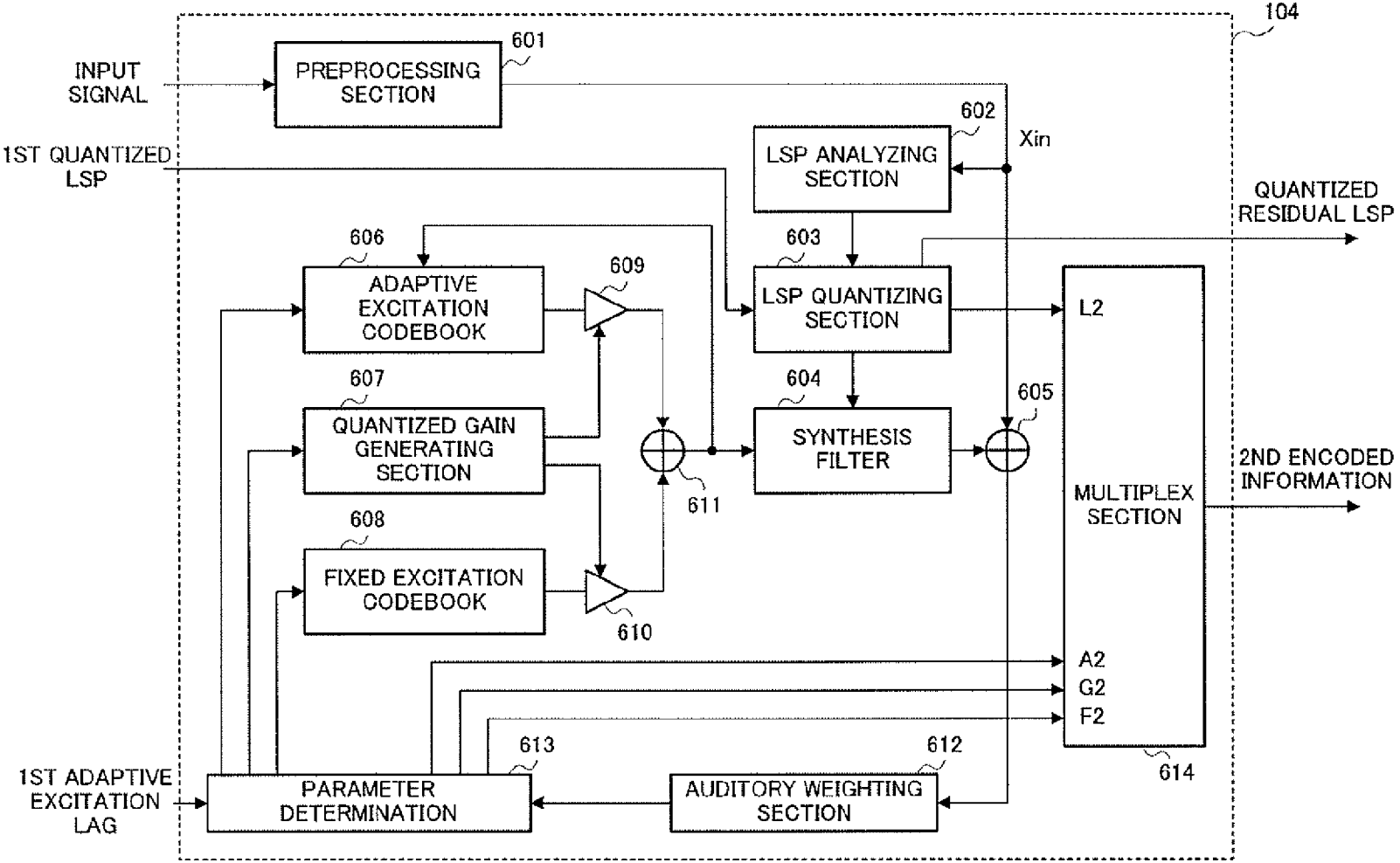
FIG. 6 is a block diagram showing an internal configuration of a second encoding section according to Embodiment 1 of the present invention.

Next, an internal configuration of second encoding section 104 will be described using FIG. 6. Second encoding section 104 separates inputted residual signals by N samples (N is a natural number) as one frame and encodes the frame for each frame, each frame containing N samples.

Input signals for second encoding section 104 are inputted to preprocessing section 601. Preprocessing section 60; performs high-pass filtering processing for removing a DC component and waveform shaping processing and pre-emphasizing processing which help to improve the performance of subsequent encoding, and outputs the processed signals (Xin) to LSP analyzing section 602 and adder 605.

LSP analyzing section 602 performs linear prediction analysis on the Xin, converts LPC (Linear Prediction Coefficients) resulting from the analysis into LSP (Line Spectral Pairs), and outputs the conversion result to LSP quantizing section 603 as second ESP.

LSP quantizing section 603 receives the first quantized LSP and the second LSP from LSP analyzing section 602. Then, LSP quantizing section 603 reverses the polarity of the first quantized LSP and adds this LSP to the second LSP, thus calculating a residual LSP. Then, LSP quantizing section 603 quantizes the residual LSP and adds the quantized residual LSP (quantized residual LSP) and the first quantized LSP, and thereby calculates second quantized LSP. Then, LSP quantizing section 603 outputs the second quantized LSP to synthesis filter 604 and outputs a second quantized LSP code (L2) indicating the quantized residual LSP to multiplex section 614. Also, LSP quantizing section 603 outputs the quantized residual LSP to decision section 105.

Synthesis filter 604 performs filter synthesis of a driving excitation outputted from adder 611 which will be described later, by a filter coefficient based on the second quantized LSP, generates a synthesis signal and outputs the synthesis signal to adder 605.

Adder 605 reverses the polarity of the synthesis signal, adds this signal to Xin, thereby calculating an error signal, and outputs the error signal to auditory weighting section 612.

Adaptive excitation codebook 606 has a buffer storing driving excitations which have so far been outputted by adder 611, extracts a set of samples for one frame from the buffer at an extraction position specified by the first adaptive excitation lag and a signal outputted from parameter determination section 613, and outputs the sample set as a second adaptive excitation vector to multiplier 609. Also, adaptive excitation codebook 606 updates the buffer, each time a driving excitation is inputted thereto from adder 611.

Quantized gain generating section 607 determines a second quantized adaptive excitation gain and a second quantized fixed excitation gain, according to a signal outputted from parameter determination section 613, and outputs these gains to multipliers 609 and 610, respectively.

Fixed excitation codebook 608 outputs a vector having a form that is specified by a signal outputted from parameter determination section 613 as a second fixed excitation vector to multiplier 610.

Multiplier 609 multiples the second quantized adaptive excitation gain outputted from quantized gain generating section 607 by the second adaptive excitation vector outputted from adaptive excitation codebook 606 and outputs the result to adder 611. Multiplier 610 multiples the second quantized fixed excitation gain outputted from quantized gain generating section 607 by the second fixed excitation vector outputted from fixed excitation codebook 608 and outputs the result to adder 611.

Adder 611 receives the second adaptive excitation vector and the second fixed excitation vector which were both multiplied by the respective gains from multiplier 6C9 and the multiplier 610, respectively, adds these vectors, and outputs a driving excitation resulting from the addition to synthesis filter 604 and adaptive excitation codebook 606. The driving excitation inputted to adaptive excitation codebook 606 is stored into the butter.

Auditory weighting section 612 applies an auditory weight to the error signal outputted from adder 605 and outputs the result as a coding distortion to parameter determination section 613.

Parameter determination section 613 selects a second adaptive excitation lag that minimizes the coding distortion outputted from auditory weighting section 612 from adaptive excitation codebook 606 and outputs a second adaptive excitation lag code (A2) indicating a selected lag to multiplex section 614. Here, the "second adaptive excitation lag" is an extraction position where the second adaptive excitation vector is extracted, and its detailed description will be provided later. Also, parameter determination section 613 selects a second fixed excitation vector that minimizes the coding distortion outputted from auditory weighting section 612 from fixed excitation codebook 608 and outputs a second fixed excitation vector code (F2) indicating a selected vector to multiplex section 614. Furthermore, parameter determination section 613 selects a second quantized adaptive excitation gain and a second quantized fixed excitation gain that minimize the coding distortion outputted from auditory weighting section 612 from quantized gain generating section 607 and outputs a second quantized excitation gain code (G2) indicating selected gains to multiplex section 614.

Multiplex section 614 receives the second quantized LSP code (L2) from LSP quantizing section 603 and receives the second adaptive excitation lag code (A2) the second fixed excitation vector code (F2) and the second quantized excitation gain code (G2) from parameter determination section 613, multiplexes these information, and outputs the result as the second encoded information.

Next, processing in which LSP quantizing section 203 determines the first quantized LSP will be outlined, taking an example of vector-quantizing the residual LSP, assigning "8" hits to the second quantized LSP code (L2).

LSP quantizing section 603 is provided with a second LSP codebook in which 256 variants of second LSP code vectors $lsp_{res}^{(l2)}(i)$ which are created in advance are stored. Here, l2 is an index attached to the second LSP code vectors, ranging from 0 to 255. The second LSP code vectors $lsp_{res}^{(l2)}(i)$ are N-dimensional vectors with ranging from 0 to N−1. LSP quantizing section 603 receives the second LSPα(i) outputted from LSP analyzing section 602. Here, the second LSPα(i) is N-dimensional vectors. Also, LSP quantizing section 603 receives the first quantized LSP $lsp_1^{(l1min)}(i)$ outputted from first local decoding section 102. Here the first quantized LSP $lsp_1^{(l1min)}(i)$ is N-dimensional vectors with i ranging from 0 to N−1.

Then, LSP quantizing section 603 obtains residual LSP res(i) by equation (2).

$$res(i)=\alpha_2(i)-lsp_1^{(l1min)}(i)\ (i=0,\ldots N-1) \tag{2}$$

Then, LSP quantizing section 603 obtains squared error $er_2$ between the residual LSP res (i) and the second LSP code vectors $lsp_{res}^{(l2)}(i)$ by equation (3)

$$er_2=\sum_{i=0}^{N-1}(res(i)-lsp_{res}^{(f2)}(i))^2 \tag{3}$$

After obtaining squared errors $er_2$ for all l2 indexes, LSP quantizing section 603 then determines l2 values that minimize squared error $er_2$ ($l2_{min}$). Then, LSP quantizing section 603 outputs $l2_{min}$ as the second quantized LSP code (L2) to multiplex section 614.

Then, LSP quantizing section 603 obtains second quantized LSP $lsp_2(i)$ by equation (4).

$$lsp_2(i)=lsp_1(i)+lsp_{res}^{(l2min)}(i)\ (i=0,\ldots N-1) \tag{4}$$

Then, LSP quantizing section 603 outputs the second quantized LSP $lsp_2(i)$ to synthesis filter 604.

$lsp_2(i)$ obtained by LSP quantizing section 603, is the "second quantized LSP", and $lsp_{res}^{(l2min)}(i)$ that minimizes squared error $er_2$ is the "quantized residual LSP".

Figure 7:
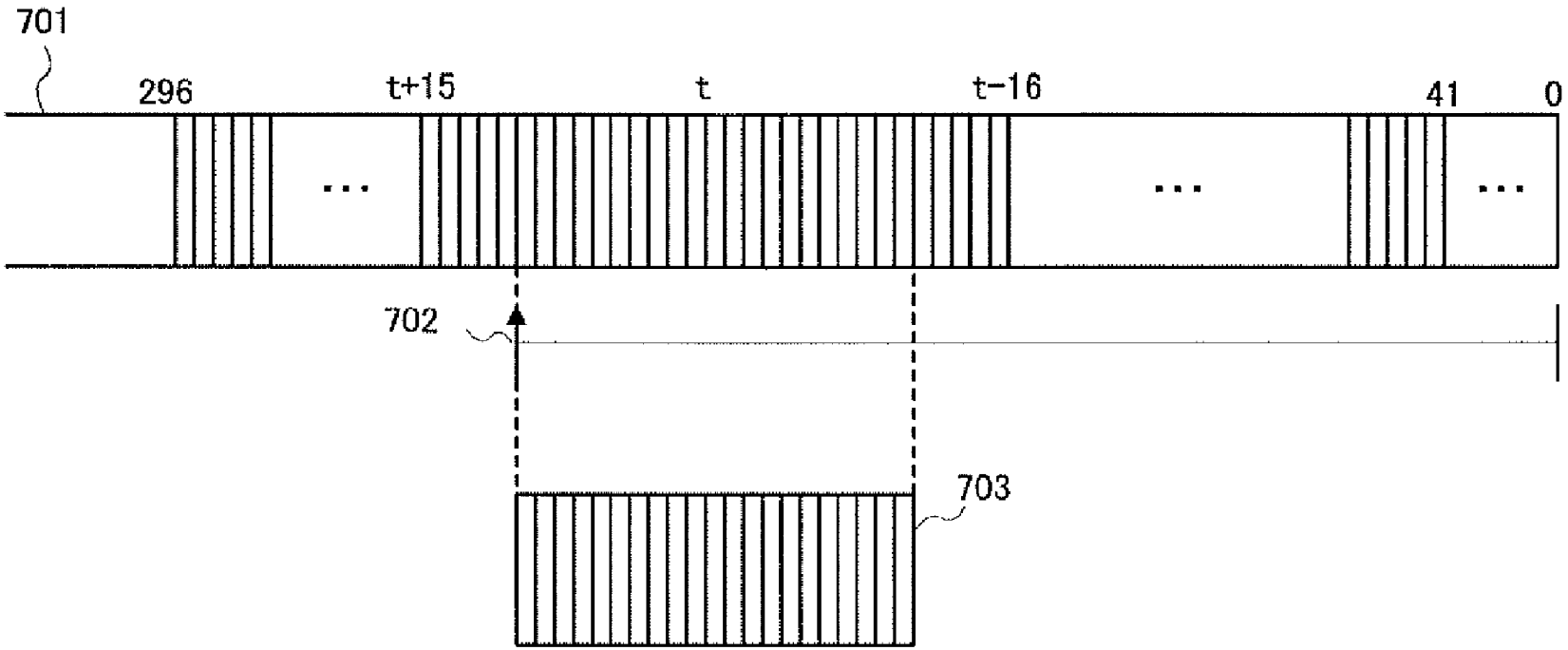
FIG. 7 is a diagram to outline processing for determining an adaptive excitation lag.

Next, processing in which parameter determination section 613 determines the second adaptive excitation lag will be described using FIG. 7. In FIG. 7, buffer 301 is the buffer that adaptive excitation codebook 606 provides, position 702 is a second adaptive excitation vector extraction position, vector 703 is an extracted second adaptive excitation vector. "t" is a first adaptive excitation lag, and values "41" and "296" correspond to lower and upper limits of the range with which parameter determination section 613 searches for the first adaptive excitation lag. "t−16" and "t+15" correspond to lower and upper limits of the range of shifting the second adaptive excitation vector extraction position.

Assuming that "5" bits are assigned to the code (A2) that represents the second adaptive excitation lag, the range of shifting extraction position 702 can be set to a range of length of "32" (for example, t−16 to t+15). Additionally, the range of shifting extraction position 702 can be arbitrarily set.

Parameter determination section 613 receives the first adaptive excitation lag t−16 from first local decoding section 102 and sets the range of shifting extraction position 702 from t−16 to t+15. Then, parameter determination section 613 shifts extraction position 702 within the set range and sequentially indicates extraction position 702 to adaptive excitation codebook 606. Then, adaptive excitation codebook 606 extracts second adaptive excitation vector 303 with a length of the frame by extraction position 702 indicated by parameter determination section 613 and outputs the extracted second adaptive excitation vector to multiplier 609. Then, parameter determination section 613 obtains the coding distortion which is outputted from auditory weighting section 612 for the case of extracting second adaptive excitation vectors 303 at all extraction positions 702 and determines extraction position 702 that minimizes the coding distortion.

When extraction position 702 of the buffer obtained by parameter determination 613 is t+γ, γ (γ is any value from −16 to 15) is the "second adaptive excitation lag". Accordingly, for extraction of second adaptive excitation vector 703 at second decoding section 154, second adaptive excitation lag 703 is extracted by adding first adaptive excitation lag t and second adaptive excitation lag γ and supplying addition result t+γ as extraction position 702.

Then, parameter determination section 613 outputs the second adaptive excitation lag code (A2) that represents the second adaptive excitation lag to multiplex section 614.

Also, parameter determination section 613 determines the second fixed excitation vector code (F2) in the same manner of processing in which parameter determination section 213 determines the first fixed excitation vector code (F1).

Moreover, parameter determination section 613 determines the second quantized excitation gain code (G2) in the same manner of processing in which parameter determination section 213 determines the first quantized excitation gain code (G1).

Next, a processing in which decision section 105 generates flag information will be described. Decision section 105 receives the first LSP from first encoding section 101, the first quantized LSP from first local decoding section 102, and the quantized residual LSP from second encoding section 104. Decision section 105 is provided with a buffer inside to store a first quantized LSP in the preceding frame.

Then, decision section 105 obtains squared error $er_3$ between the first LSP and the first quantized LSP in the preceding frame by equation (5).

$$er_3 = \sum_{i=0}^{N-1} (\alpha_1(i) - lsp_{pre1}(i))^2 \quad (5)$$

where, $\alpha(i)$ is the first LSP and $lsp_{pre1}$ (i) is the first quantized LSP in the preceding frame stored in the buffer.

Then, decision section 105 obtains squared error er4 between the first LSP and a vector as the sum of the first quantized LSP in the preceding frame and the quantized residual LSP.

$$er_4 = \sum_{i=0}^{N-1} (\alpha_1(i) - (lsp_{pre1}(i) + lsp_{res}(i)))^2 \quad (6)$$

where, $lsp_{res}(i)$ is the quantized residual LSP.

Then, decision section 105 compares squared error $er_3$ with squared error $er_4$ in terms of magnitude. If squared error $er_3$ is smaller, the flag takes a value of "0", and, if squared error $er_4$ is smaller, the flag takes a value of "1". Then, the decision section 105 outputs the flag information to the multiplex section 106. Then, decision section 105 stores the first quantized LSP inputted from first local decoding section 102, thus updating the buffer. The thus stored first quantized LSP is used as the first quantized LSP in the preceding frame for the next frame.

By thus comparing the case of using the first encoded information in the preceding frame and another case of using both the first encoded information in the preceding frame and the quantized residual LSP and by transmitting information indicating which case can produce a value closer to the first LSP to the decoding apparatus side as the flag information, it can be indicated whether the first decoding section should decode using only the first encoded information in the preceding frame or decode using both the first encoded information in the preceding frame and the quantized residual LSP if a first encoded information loss is detected at the decoding apparatus side.

Figure 8:
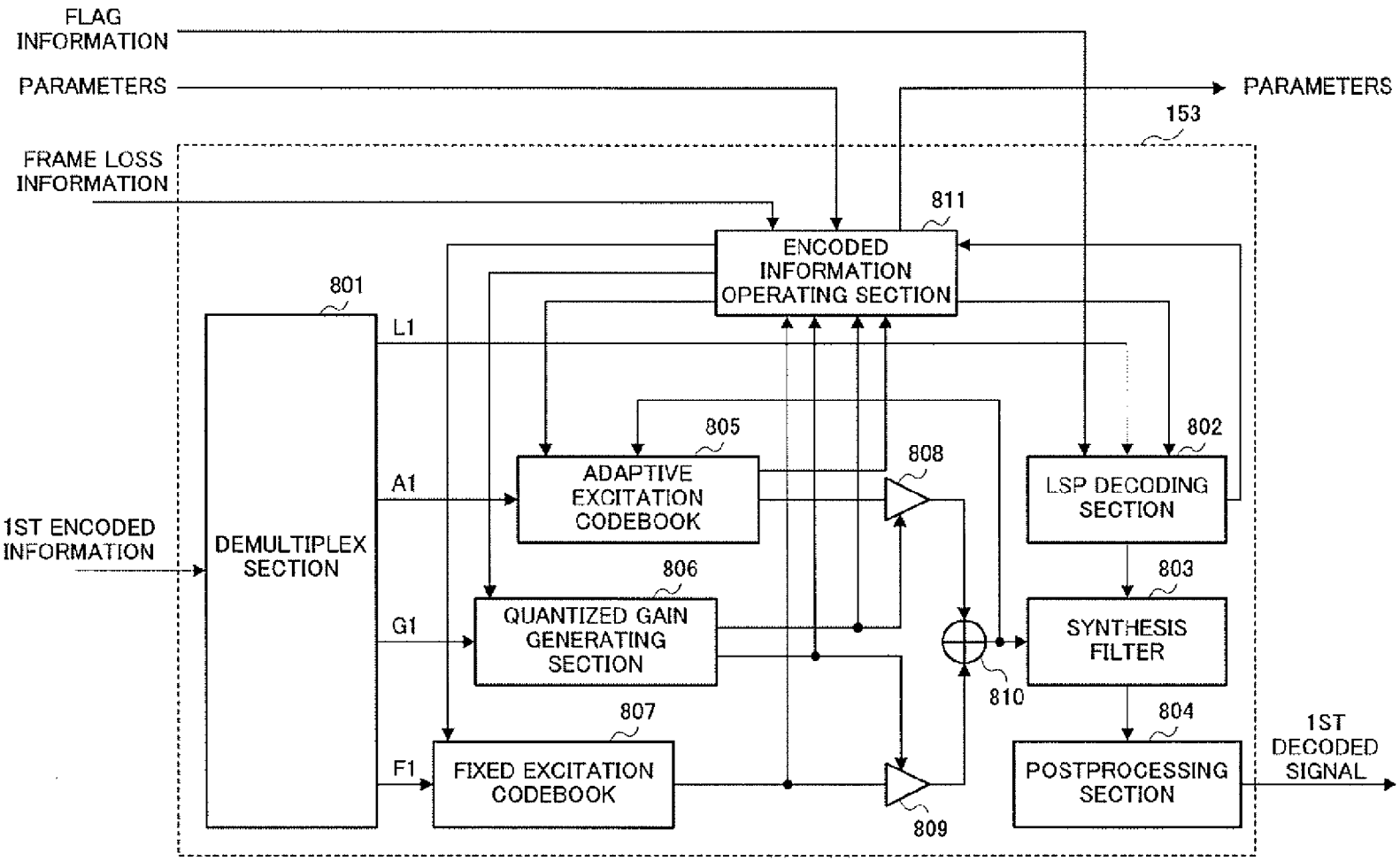
FIG. 8 is a block diagram snowing an internal configuration of a first decoding section according to Embodiment 1 of the present invention.

Next, an internal structure of first decoding section 153 will be described, using the block diagram shown in FIG. 8. In FIG. 5, if first encoded information is transmitted without loss, first encoded information inputted to first decoding section 153 is demultiplexed into individual codes (L1, A1, G1, F1) by demultiplex section 801. The first quantized LSP code (L1) demultiplexed from the first encoded information is outputted to LSP decoding section 802; the first adaptive excitation lag code (A1) demultiplexed as well is outputted to adaptive excitation codebook 805; the first quantized excitation gain code (G1) demultiplexed as well is outputted to quantized gain generating section 806; and the first fixed excitation vector code (F1) demultiplexed as well is outputted to fixed excitation codebook 807.

LSP decoding section 802 receives flag information from demultiplex section 151 and frame loss information from encoded information operating section 811. If the frame loss information is "1" or "3", LSP decoding section 802 receives the first quantized LSP code (L1) from demultiplex section 801 and decodes the first quantized LSP code (L1) into the first quantized LSP. If the frame loss information is "0", LSP decoding section 802 receives the first quantized LSP in the preceding frame from encoded information operating section 311 and supplies it as the first quantized LSP. If the frame loss information is "2", LSP decoding section 802 receives the first quantized LSP in the preceding frame and the quantized residual LSP from encoded information operating section 811, adds these LSPs, and supplies the first quantized LSP resulting from the addition. However, LSP decoding section 802 does not use the quantized residual LSP, if the flag information is "0". Then, LSP decoding section 802 outputs said first quantized LSP to synthesis filter 803 and encoded information operating section 81Y. The first quantized LSP outputted to encoded information operating section 811 is used as the first quantized LSP in the preceding frame, when decoding for the next frame is executed.

Adaptive excitation codebook 805 has a buffer storing driving excitations which have so far been outputted by adder 810. Adaptive excitation codebook 805 receives frame loss information from encoded in Formation operating section 811. If the frame loss information is "1" or "3", adaptive excitation codebook 805 receives the first adaptive excitation lag code (A1) from demultiplex section 801, extracts a set of samples for one frame from the buffer at an extraction position specified by the first adaptive excitation lag code (A1), and supplies the thus extracted vector as a first adaptive excitation vector. If the frame loss information is "0", adaptive excitation codebook 805 receives the first adaptive excitation lag in the preceding frame from encoded information operating section 811, extracts a set of samples for one frame from the buffer at an extraction position specified by the first adaptive excitation lag in the preceding frame, and supplies the thus extracted vector as a first adaptive excitation vector. If the frame loss information is "2", adaptive excitation codebook 805 receives the first adaptive excitation lag in the preceding frame and the second adaptive excitation lag from the encoded information operating section 81, extracts a set of samples for one frame from the buffer at an extraction position specified by a result of the addition of these Tags, and supplies the thus extracted vector as a first adaptive excitation veccor.

Then, adaptive excitation codebook 805 outputs the first adaptive excitation vector to multiplier 808. Also, adaptive excitation codebook 305 outputs the first adaptive excitation vector extraction position as a first adaptive excitation lag to encoded information operating section 811. The first adaptive excitation lag outputted to encoded information operating section 811 is used as the first adaptive excitation lag in the preceding frame, when decoding for the next frame is executed. Moreover, adaptive excitation codebook 805 updates the buffer, each time a driving excitation is inputted thereto from adder 910.

Quantized gain generating section 806 receives frame loss information from encoded information operating section 811. If the frame loss information is "1" or "3", quantized gain generating section 806 receives the first quantized excitation gain code (G1) from demultiplex section 801 and decodes to obtain the first quantized adaptive excitation gain and the first quantized fixed excitation gain which are specified by the first quantized excitation gain code (G1). If the frame loss information is "0", quantized gain generating section 806 receives the first quantized adaptive excitation gain in the preceding frame and the first quantized fixed excitation gain in the preceding frame from encoded information operating section 811 and supplies these gains as the first quantized adaptive excitation gain and the first quantized fixed excitation gain. If the frame loss information is "2", quantized gain generating section 806 receives the first quantized adaptive excitation gain in the preceding frame, the first quantized fixed excitation gain in the preceding frame, the second quantized adaptive excitation gain, and the second quantized fixed excitation gain from encoded information operating section 811. Then, quantized gain generating section 806 adds the first quantized adaptive excitation gain in the preceding frame and the second quantized adaptive excitation gain, multiplies a result of the addition by 0.5, and supplies the multiplication result as the first quantized adaptive excitation gain. Also, quantized gain generating section 806 adds the first quantized fixed excitation gain in the preceding frame and the second quantized fixed excitation gain, multiplies the addition result by 0.5, and supplies the multiplication result as the first quantized fixed excitation gain. Then, quantized gain generating section 806 outputs the first quantized adaptive excitation gain to multiplier 808 and encoded information operating section 811 and outputs the first quantized fixed excitation gain to multiplier 809 and encoded information operating section 811. The first quantized adaptive excitation gain and the first quantized fixed excitation gain outputted to encoded information operating section 811 are used as the first quantized adaptive excitation gain in the preceding frame and the first quantized fixed excitation gain in the preceding frame, when decoding processing for the next frame is executed.

Fixed excitation codebook 807 receives frame loss information from encoded information operating section 811. If the frame information is "1" or "3", fixed excitation codebook 807 receives the first fixed excitation vector code (F1) from demultiplex section 80C and generates the first fixed excitation vector specified by the first fixed excitation vector code (F1). If the frame information is "0" or "2", fixed excitation codebook 807 receives the first fixed excitation vector in the preceding frame from encoded information operating section 811 and supplies this vector as the first fixed excitation vector. Then, fixed excitation codebook 807 outputs the first fixed excitation vector to multiplier 809 and encoded information operating section 811. The first fixed excitation vector outputted to encoded information operating section 811 is used as the first fixed excitation vector in the preceding frame, when decoding processing for the next frame is executed.

Multiplier 808 multiplies the first adaptive excitation vector by the first quantized adaptive excitation gain and outputs the result to adder 810. Multiplier 809 multiplies the first fixed excitation vector by the first quantized fixed excitation gain and outputs the result to adder 810.

Adder 810 adds the first adaptive excitation vector and the first fixed excitation vector multiplied by the respective gains, outputted from multipliers 803 and 809, thus generates a driving excitation, and outputs the driving excitation to synthesis filter 803 and adaptive excitation codebook 805.

Synthesis filter 803 performs filter synthesis on the driving excitation outputted from adder 810 with the filter coefficient decoded by LSP decoding section 802 and outputs a synthesis signal to postprocessing section 804.

Postprocessing section 504 processes the synthesis signal outputted from synthesis filter 803 by processing for improving a subjective speech quality, such as format emphasizing and pitch emphasizing, and by processing for improving a subjective stationary noise quality, and outputs the processed signal as a first decoded signal.

Encoded information operating section 811 is provided with a buffer inside to store various parameters. In the buffer, the first quantized LSP obtained in the preceding frame (first quantized LSP in the preceding frame), the first adaptive excitation lag obtained in the preceding frame (first adaptive excitation lag in the preceding frame), the first quantized adaptive excitation gain obtained in the preceding frame (first quantized adaptive excitation gain in the preceding frame), the first quantized fixed excitation gain obtained in the preceding frame (first quantized fixed excitation gain in the preceding), and the first fixed excitation vector obtained in the preceding frame (first fixed excitation vector in the preceding frame) are stored.

Encoded information operating section 811 receives frame loss information from frame loss detecting section 152.

If the frame loss information is "2", then encoded information operating section 811 receives the quantized residual LSP, the second adaptive excitation lag, the second quantized adaptive excitation gain, and the second quantized fixed excitation gain from second decoding section 154. Then, encoded information operating section 811 outputs the frame loss information to ISP decoding section 802, adaptive excitation codebook 805, quantized gain generating section 806 and fixed excitation codebook 807. If the frame loss information is "0", encoded information operating section 811 outputs the first quantized LSP in the preceding frame to LSP decoding section 802, the first adaptive excitation lag in the preceding frame to adaptive excitation codebook 805, the first quantized adaptive excitation gain in the preceding frame and the first quantized fixed excitation gain in the preceding frame to quantized gain generating section 806, and the first fixed excitation vector in the preceding frame to fixed excitation codebook 807. If the frame loss information is "2", encoded information operating section 811 outputs the first quantized LSP in the preceding frame and the quantized residual LSP to LSP decoding section 802, the first adaptive excitation lag in the preceding frame and the second adaptive excitation lag to adaptive excitation codebook 805, the first quantized adaptive excitation gain in the preceding frame, the first quantized fixed excitation gain in the preceding frame, the second quantized adaptive excitation gain, and the second quantized fixed excitation gain to quantized gain generating section 806, and the first fixed excitation vector to fixed excitation codebook 807.

Then, encoded information operating section 811 receives the first quantized LSP used in decoding for the current frame from LSP decoding section 802, the first adaptive excitation lag from adaptive excitation codebook 805, the first quantized adaptive excitation gain and the first quantized fixed excitation gain from quantized gain generating section 806, and the first fixed excitation vector from fixed excitation codebook 807. If the frame information is "1" or "3", then encoded information operating section 811 outputs the first quantized LSP, the first adaptive excitation lag, the first quantized adaptive excitation gain, and the first quantized fixed excitation gain no second decoding section 154. If the frame loss information is "0" or "2", encoded information operating section 511 outputs the first quantized LSP in the preceding frame and the first adaptive excitation lag in the preceding frame, stored in the buffer, to second decoding section 154.

Upon completion of the above processing, encoded information operating section 811 stores the first quantized LSP, the first adaptive excitation lag, the first quantized adaptive excitation gain, the first quantized fixed excitation gain, and the first fixed excitation vector, which are applied in decoding for the current frame, into the buffer, as the first quantized LSP in the preceding frame, the first adaptive excitation lag in the preceding frame, the first quantized adaptive excitation gain in the preceding frame, the first quantized fixed excitation gain in the preceding frame, and the first fixed excitation vector in the preceding frame, thus updating the buffer.

Figure 9:
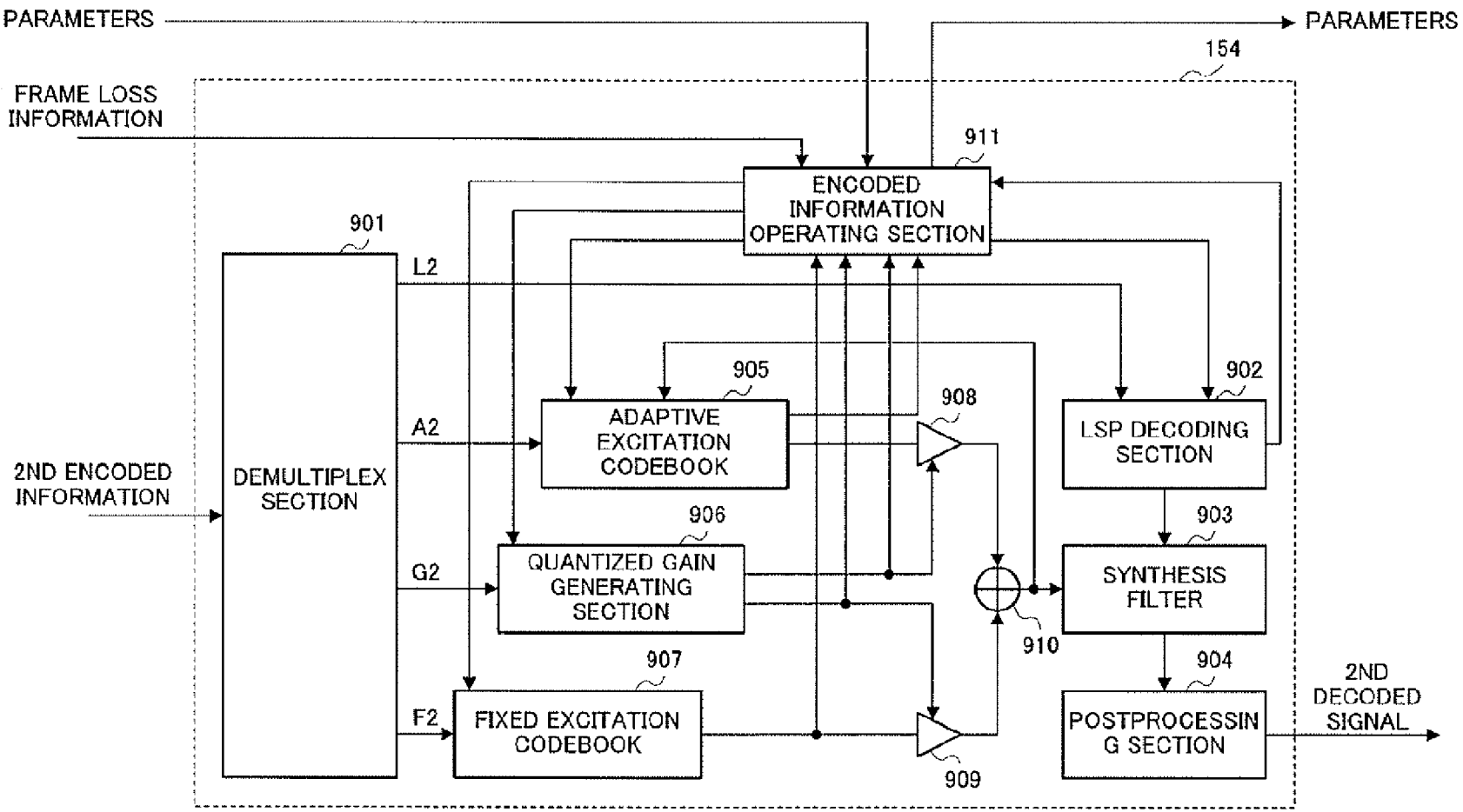
FIG. 9 is a block diagram showing an internal configuration of a second decoding section according to Embodiment 1 of the present invention.

Next, an internal configuration of second decoding section 154 will be described, using the block diagram shown in FIG. 9. In FIG. 9, if second encoded information is transmitted without loss, the second encoded information inputted to second decoding section 153 is demultiplexed into individual codes (L2, A2, G2 and F2) by demultiplex section 901. The second quantized LSP code (L2) demultiplexed from the second encoded information is outputted to LSP decoding section 902; the second adaptive excitation lag code (A2) demultiplexed as well is outputted to adaptive excitation codebook 905; the second quantized excitation gain code (G2) demultiplexed as well is outputted to quantized gain generating section 906; and the second fixed excitation vector code (F2) demultiplexed as well is outputted to fixed excitation codebook 907.

LSP decoding section 902 receives frame loss information from encoded information operating section 911. If the frame loss information is "3", LSP decoding section 902 receives the first quantized LSP from encoded information operating section 911 and the second quantized LSP code (L2) from demultiplex section 901, decodes the second quantized LSP code (L2) into quantized residual LSP, adds the first quantized LSP and the quantized residual LSP, and supplies the addition result as second quantized LSP. If the frame loss information is "1", LSP decoding section 902 receives the first quantized LSP and the quantized residual LSP in the preceding frame from encoded information operating section 911, adds the first quantized LSP and the quantized residual LSP in the preceding frame, and supplies the addition result as second quantized LSP. If the frame loss information is "2", LSP decoding section 902 receives the first quantized LSP in the preceding frame from encoded information operating section 911 and the second quantized LSP code (L2) from demultiplex section 901, decodes the second quantized LSP code (L2) into quantized residual LSP, adds the first quantized LSP in the preceding frame and the quantized residual LSP, and supplies the addition result as second quantized LSP. If the frame loss information is "0", LSP decoding section 902 receives the first quantized LSP in the preceding frame and the quantized residual LSP in the preceding frame from encoded information operating section 911, adds the first quantized LSP in the preceding frame and the quantized residual LSP in the preceding frame, and supplies the addition result as second quantized LSP.

Then, LSP decoding section 902 outputs the second quantized LSP to synthesis filter 903. If the frame loss information is "2" or "3", then LSP decoding section 902 outputs the quantized residual LSP obtained by decoding the second quantized LSP code (L2) to encoded information operating section 911. If the frame loss information is "0" or "1", LSP decoding section 902 outputs the quantized residual LSP in the preceding frame to encoded information operating section 911. The quantized residual LSP or the quantized residual LSP in the preceding frame outputted to encoded information operating section 911 is used as the quantized residual LSP in the preceding frame, when decoding processing for the next frame is executed.

Adaptive excitation codebook 905 has a buffer storing driving excitations which have so far been outputted by adder 910. Adaptive excitation codebook 905 receives frame loss information from encoded in formation operating section 911.

If the frame loss information is "3", adaptive excitation codebook 905 receives the first adaptive excitation lag from encoded information operating section 911 and the second adaptive excitation lag code (A2) from demultiplex section 90D, adds the first adaptive excitation lag and the second adaptive excitation lag code (A2), extracts a set of samples for one frame from the buffer at an extraction position specified by the addition result, and supplies the thus extracted vector as a second adaptive excitation vector. If the frame loss information is "1", adaptive excitation codebook 905 receives the first adaptive excitation lag and the second adaptive excitation lag in the preceding frame from encoded information operating section 911, adds these adaptive excitation lags, extracts a set of samples for one frame from the buffer at an extraction position specified by the addition result, and supplies the thus extracted vector as a second adaptive excitation vector. If the frame loss information is "2", adaptive excitation codebook 905 receives the first adaptive excitation lag in the preceding frame from encoded information operating section 911 and the second adaptive excitation lag code (A2) from demultiplex section 901, adds the first adaptive excitation lag in the preceding frame and the second adaptive excitation lag code (A2), extracts a set of samples for one frame from the buffer at an extraction position specified by the addition result, and supplies the thus extracted vector as a second adaptive excitation vector. If the frame loss information is "0" adaptive excitation codebook 905 receives the first adaptive excitation lag in the preceding frame and the second adaptive excitation lag in the preceding frame from encoded information operating section 911, adds these adaptive excitation lags, and extracts a set of samples for one frame from the buffer at an extraction position specified by the addition result, and supplies the thus extracted vector as a second adaptive excitation vector.

Then, adaptive excitation codebook 905 outputs the second adaptive excitation vector to multiplier 908. Also, adaptive excitation codebook 905 outputs the second adaptive excitation lag code (A2) as the second adaptive excitation lag to encoded information operating section 911, if the frame loss information is "2" or "3"; it outputs the second adaptive excitation lag in the preceding frame to encoded information operating section 911, if the frame loss information is "0" or "1". The second adaptive excitation lag or the second adaptive excitation lag in the preceding frame outputted to encoded information operating section 911 is used as the second adaptive excitation lag in the preceding frame, when decoding processing for the next frame is executed. Moreover, adaptive excitation codebook 905 updates the buffer, each time a driving excitation is inputted thereto from adder 910.

Quantized gain generating section 906 receives frame loss information from encoded information operating section 911. If the frame loss information is "2" or "3", quantized gain generating section 906 receives the second quantized excitation gain code (G2) from demultiplex section 901 and decodes to obtain the second quantized adaptive excitation gain and the second quantized fixed excitation gain which are specified by the second quantized excitation gain code (G2). If the frame loss information is "1", quantized gain generating section 906 receives the first quantized adaptive excitation gain, the first quantized fixed excitation gain, the second quantized adaptive excitation gain in the preceding frame, and she second quantized fixed excitation gain in the preceding frame from encoded information operating section 911. Then, quantized gain generating section 906 adds the first quantized adaptive excitation gain and the second quantized adaptive excitation gain in the preceding frame, multiplies she addition result by 0.5, and supplies the multiplication result as the second quantized adaptive excitation gain. Also, quantized gain generating section 906 adds the first quantized fixed excitation gain and the second quantized fixed excitation gain in the preceding frame, multiplies the addition result by 0.5, and supplies the multiplication result as the second quantized adaptive excitation gain. If the frame loss information is "0", quantized gain generating section 906 receives the second quantized adaptive excitation gain in the preceding frame and the second quantized fixed excitation gain in the preceding frame from encoded information operating section 911 and supplies these gains as the second quantized adaptive excitation gain and the second quantized fixed excitation gain.

Then, quantized gain generating section 906 outputs the second quantized adaptive excitation gain to multiplier 908 and encoded information operating section 911 and outputs the second quantized fixed excitation gain to multiplier 909 and encoded information operating section 911. The second quantized adaptive excitation gain and the second quantized fixed excitation gain outputted to encoded information operating section 911 are used as the second quantized adaptive excitation gain in the preceding frame and the second quantized fixed excitation gain in the preceding frame, when decoding processing for the next frame is executed.

Fixed excitation codebook 907 receives frame loss information from encoded information operating section 911. If the frame information is "2" or "3", fixed excitation codebook 907 receives the second fixed excitation vector code (F2) from demultiplex section 901 and generates the second fixed excitation vector specified by the second fixed excitation vector code (F2'. If the frame information is "0" or "1", fixed excitation codebook 907 receives the second fixed excitation vector in the preceding frame from encoded information operating section 911 and supplies this vector as the second fixed excitation vector. Then, fixed excitation codebook 907 outputs the second fixed excitation vector to multiplier 909 and encoded information operating section 911. The second fixed excitation vector outputted to encoded information operating section 911 is used as the second fixed excitation vector in the preceding frame, when decoding processing for the next frame is executed.

Multiplier 908 multiples the second adaptive excitation vector by the second quantized adaptive excitation gain and outputs the result to adder 910. Multiplier 909 multiples the second fixed excitation vector by the second quantized fixed excitation gain and outputs the result to adder 910.

Adder 910 adds the second adaptive excitation vector and the second fixed excitation vector multiplied by the respective gains, outputted from multipliers 908 and 909, thus generates a driving excitation, and outputs the driving excitation to synthesis filter 903 and adaptive excitation codebook 905.

Synthesis filter 903 performs filter synthesis on the driving excitation outputted from adder 910 with the filter coefficient decoded by LSP decoding section 902 and outputs a synthesis signal to postprocessing section 904.

Postprocessing section 904 processes the synthesis signal outputted from synthesis filter 903 by processing for improving a subjective speech quality, such as format emphasizing and pitch emphasizing, and by processing for improving a subjective stationary noise quality, and outputs the processed signal as a second decoded signal.

Encoded information operating section 911 is provided with a buffer inside to store various parameters. In the buffer, the quantized residual LSP obtained in the preceding frame (quantized residual LSP in the preceding frame), the second adaptive excitation lag obtained in the preceding frame (second adaptive excitation lag in the preceding frame), the second quantized adaptive excitation gain obtained in the preceding frame (second quantized adaptive excitation gain in the preceding frame), the second quantized fixed excitation gain obtained in the preceding frame (second quantized fixed excitation gain in the preceding), and the second fixed excitation vector obtained in the preceding frame (second fixed excitation vector in the preceding frame) are stored.

Encoded information operating section 911 receives frame loss information from frame loss detecting section 152. If the frame loss information is "1" or "3", encoded information operating section 911 receives the first quantized LSP, the first adaptive excitation lag, the first quantized adaptive excitation gain, and the first quantized fixed excitation gain from first decoding section 153. If the frame joss information is "0" or "2", encoded information operating section 911 receives the first quantized LSP in the preceding frame and the first adaptive excitation lag in the preceding frame from first decoding section 153. Then, encoded information operating section 911 outputs the frame loss information to LSP decoding section 902, adaptive excitation codebook 905, quantized gain generating section 9C6 and fixed excitation codebook 907. If the frame less information is "0", encoded information operating section 911 outputs the first quantized LSP in the preceding frame and the quantized residual LSP in the preceding frame to LSP decoding section 902, the first adaptive excitation lag in the preceding frame and the second adaptive excitation lag in the preceding frame to adaptive excitation codebook 905, the second quantized adaptive excitation gain in the preceding frame and the second quantized fixed excitation gain in the preceding frame to quantized gain generating section 906, and the second fixed excitation vector in the preceding frame to fixed excitation codebook 907. If the frame loss information is "1", encoded information operating section 911 outputs the first quantized ISP and the quantized residual LSP in the preceding frame to LSP decoding section 902, the first adaptive excitation lag and the second adaptive excitation lag in the preceding frame to adaptive excitation codebook 905, the first quantized adaptive excitation gain, the first quantized fixed excitation gain, the second quantized adaptive excitation gain in the preceding frame, and the second quantized fixed excitation gain, the preceding frame to quantized gain generating section 906, and the second fixed excitation vector in the preceding frame to fixed excitation codebook 907. If the frame loss information is "2", encoded information operating section 911 outputs the first quantized LSP in the preceding frame to LSP decoding section 902 and the first adaptive excitation lag in the preceding frame to adaptive excitation codebook 905. If the frame loss information is "3", encoded information operating section 911 outputs the first quantized LSP to LSP decoding section 902 and the first adaptive excitation lag to adaptive excitation codebook 905.

Then, encoded information operating section 911 receives the quantized residual LSP used in decoding for the current frame from LSP decoding section 902, the second adaptive excitation lag from adaptive excitation codebook 905, the second quantized adaptive excitation gain and the second quantized fixed excitation gain from quantized gain generating section 906, and the second fixed excitation vector from fixed excitation codebook 907. Then, encoded information operating section 911 outputs the quantized residual LSP, the second adaptive excitation lag, the second quantized adaptive excitation gain, and the second quantized fixed excitation gain to first decoding section 153, if the frame loss information is "2".

Upon completion of the above processing, encoded information operating section 911 stores the quantized residual LSP, the second adaptive excitation lag, the second quantized adaptive excitation gain, the second quantized fixed excitation gain, and the second fixed excitation vector, which are used in decoding for the current frame, into the buffer, as the quantized residual LSP in the preceding frame, the second adaptive excitation lag in the preceding frame, the second quantized adaptive excitation gain in the preceding frame, the second quantized fixed excitation gain in the preceding frame, and the second fixed excitation vector in the preceding frame, thus updating the buffer.

In first decoding section 153 and second decoding section 154, as described above, by selecting appropriate parameters for use in decoding from among the first encoded information, second encoded information, first encoded information in the preceding frame, and second encoded information in the preceding frame, according to frame loss information, it is possible to perform decoding suited for encoded information loss state and obtain decoded signals with good quality.

Figure 10:
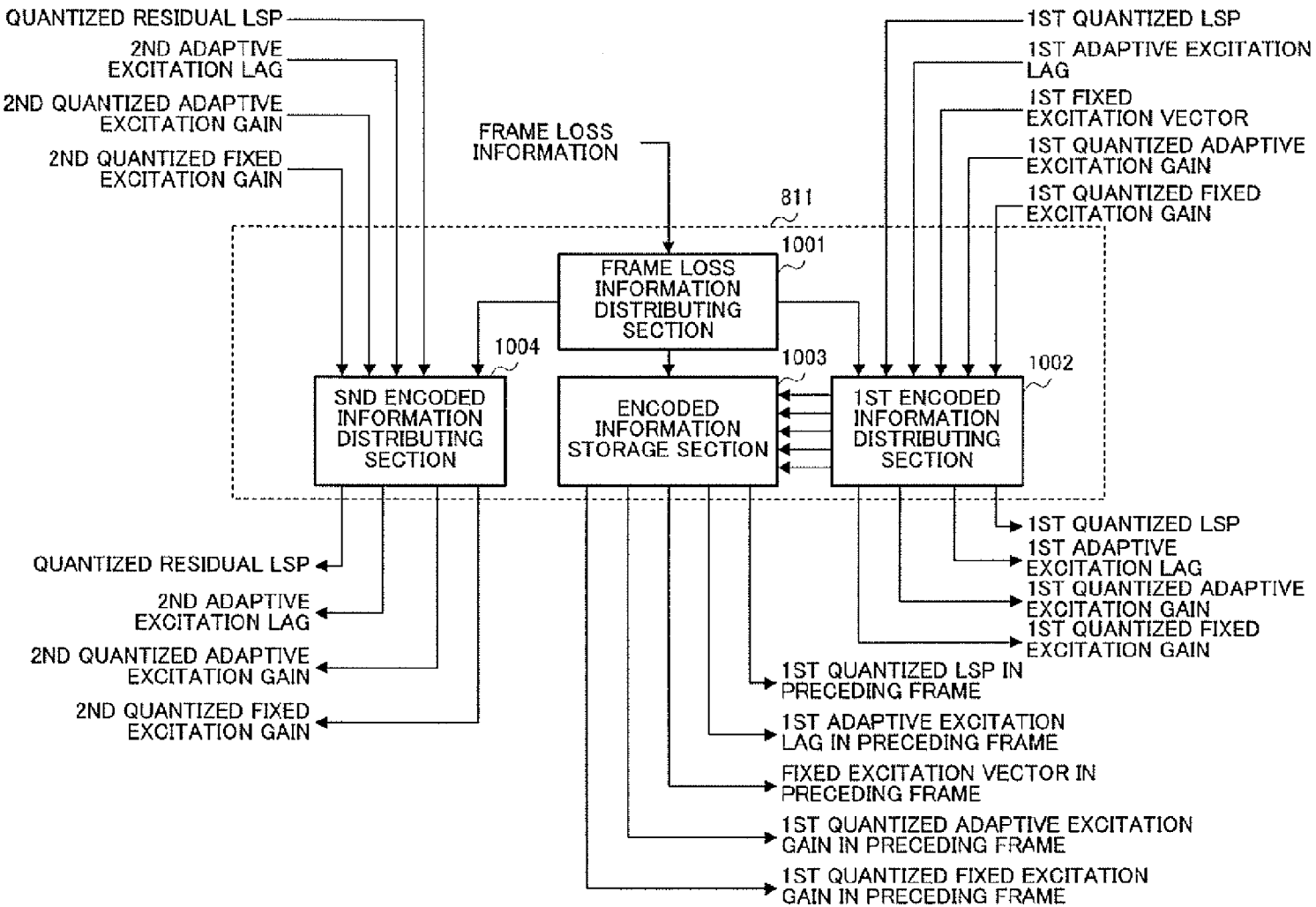
FIG. 10 is a block diagram showing an internal configuration of an encoded information operation according to Embodiment 1 of the present invention.

Next, an internal configuration of encoded information operating section 811 will be described, using the block diagram shown in FIG. 10. Frame less information distributing section 1001 receives frame loss information from frame loss detecting section 152 and outputs this information to first encoded information distributing section 1002, encoded information storage section 1003, second encoded information distributing section 1004, LSP decoding section 802, adaptive excitation codebook 805, quantized gain generating section 806 and fixed excitation codebook 807.

First encoded information distributing section 1002 receives frame loss information from frame loss information distributing section 1001. Then, first encoded information distributing section 1002 receives the first quantized LSP from LSP decoding section 902, the first adaptive excitation lag from adaptive excitation codebook 805, the first quantized adaptive excitation gain and the first quantized fixed excitation gain from quantized gain generating section 806, and the first fixed excitation vector from fixed excitation codebook 807. Then, first encoded information distributing section 1002 outputs the first quantized LSP, the first adaptive excitation lag, the first fixed excitation vector, the first quantized adaptive excitation gain, and the first quantized fixed excitation gain to encoded information storage section 1003. If the frame loss information is "1" or "3", then first encoded information distributing section 1002 outputs the first quantized LSP, the first adaptive excitation lag, the first fixed excitation vector, the first quantized adaptive excitation gain and the first quantized fixed excitation gain to second decoding section 154.

Encoded information storage section 1003 receives frame loss information from frame loss information distributing section 1001. Encoded information storage section 1003 is provided with a buffer inside to store the first quantized LSP, first adaptive excitation lag, first fixed excitation vector, first quantized adaptive excitation gain and first quantized fixed excitation gain in the preceding frame. If the frame loss information is "0" or "2", then encoded information storage section 1003 outputs the first quantized LSP in the preceding frame to LSP decoding section 802, the first adaptive excitation lag in the preceding frame to adaptive excitation codebook 805, the first fixed excitation vector in the preceding frame to fixed excitation codebook 807, and the first quantized adaptive excitation gain in the preceding frame and the first quantized fixed excitation gain in the preceding frame to quantized gain generating section 806. If the frame loss information is "0" or "2", moreover, encoded information storage section 1003 outputs the first quantized LSP in the preceding frame and the first adaptive excitation lag in the preceding frame to second decoding section 154. Then, encoded information storage section 1003 receives the first quantized LSP, first adaptive excitation lag, first fixed excitation vector, first quantized adaptive excitation gain and first quantized fixed excitation gain from first encoded information distributing section 1002. Then, encoded information storage section 1003 stores the first quantized LSP, first adaptive excitation lag, first fixed excitation vector, first quantized adaptive excitation gain, and first quantized fixed excitation gain into the buffer, thus updating the buffer. The thus stored first quantized LSP, first adaptive excitation lag, first fixed excitation vector, first quantized adaptive excitation gain and first quantized fixed excitation gain are used for the next frame as the first quantized LSP in the preceding frame, the first adaptive excitation lag in the preceding frame, the first fixed excitation vector in the preceding frame, the first quantized adaptive excitation gain in the preceding frame and the first quantized fixed excitation gain in the preceding frame.

Second encoded information distributing section 1004 receives frame loss information from frame loss information distributing section 1001. If the frame loss information is "2", then second encoded information distributing section 1004 receives the quantized residual LSP, the second adaptive excitation lag, the second quantized adaptive excitation gain, and the second quantized fixed excitation gain from second decoding section 154. If the frame loss information is "2", then second encoded information distributing section 1004 outputs the quantized residual LSP to LSP decoding section 802, the second adaptive excitation lag to adaptive excitation codebook 805, and the second quantized adaptive excitation gain and the second quantized fixed excitation gain to quantized gain generating section 806.

Figure 11:
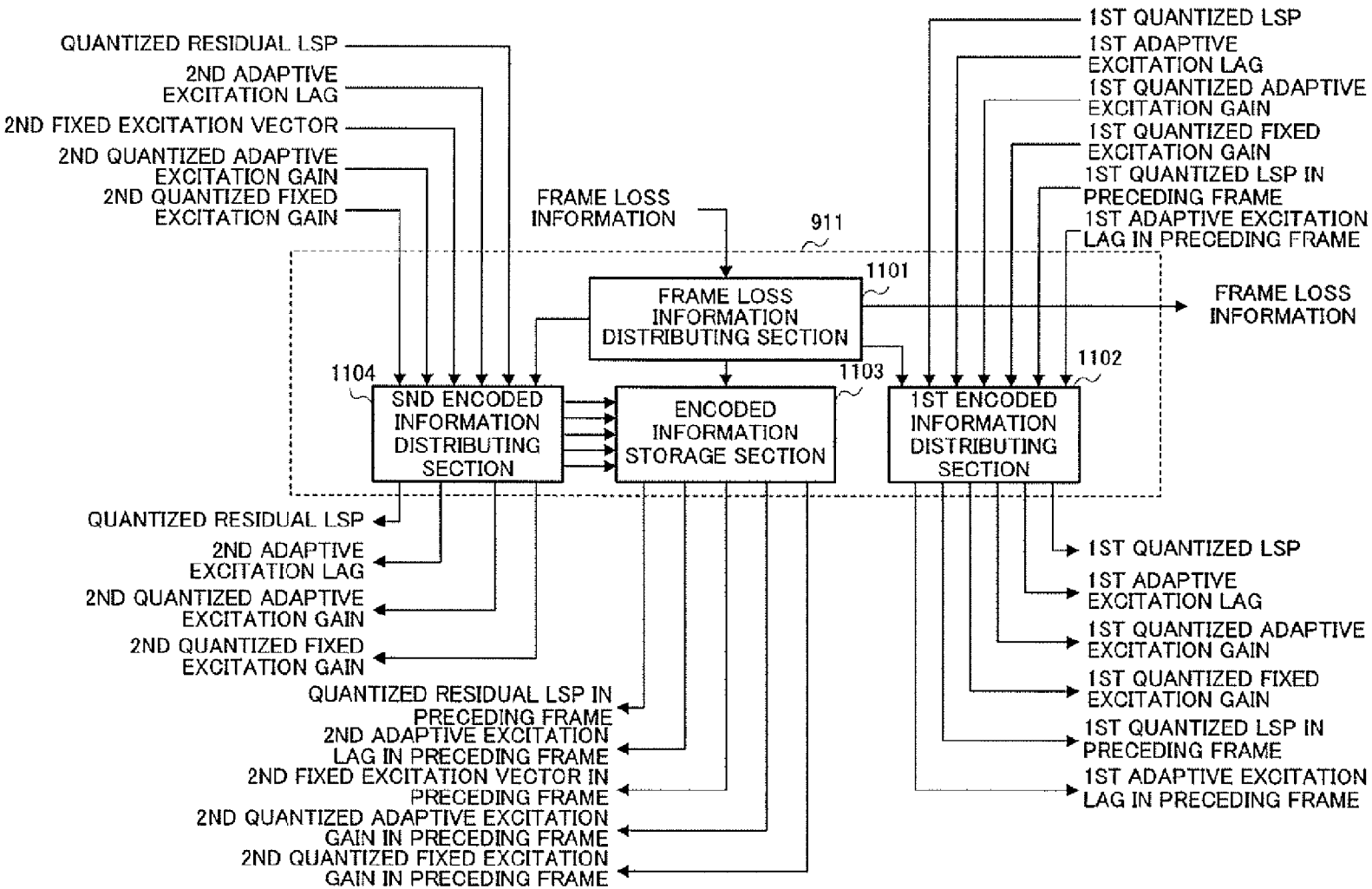
FIG. 11 is a block diagram showing an internal configuration of an encoded information operating section according to Embodiment 1 of the present invention.

Next, an internal configuration of encoded information operating section 911 will be described, using the block diagram shown in FIG. 11. Frame loss information distributing section 1101 receives frame loss information from frame loss detecting section 152 and outputs this information to first encoded information distributing section 1102, encoded information storage section 1103, second encoded information distributing section 1104, LSP decoding section 902, adaptive excitation codebook 905, quantized gain generating section 906 and fixed excitation codebook 907.

First encoded information distributing section 1102 receives frame loss information from frame loss information distributing section 1101. If the frame loss information is "1" or "3", then first encoded information distributing section 1102 receives the first quantized LSP, first adaptive excitation lag, first quantized adaptive excitation gain and first quantized fixed excitation gain from first decoding section 153. If the frame loss information "0" or "2", first encoded information distributing section 1102 receives the first quantized LSP in the preceding frame and the first adaptive excitation lag in the preceding frame from first decoding section 153. If the frame loss information is "1" or "3", then first encoded information distributing section 1102 outputs the first quantized LSP to LSP decoding section 902 and the first adaptive excitation lag to adaptive excitation codebook 905. If the frame loss information is "1", first encoded information distributing section 1102 outputs the first quantized adaptive excitation gain and the first quantized fixed excitation gain to quantized gain generating section 906. If the frame loss information is "0" or "2", first encoded information distributing section 1102 outputs the first quantized LSP in the preceding frame to the LSP decoding section 902 and the first adaptive excitation lag in the preceding frame to adaptive excitation codebook 905.

Second encoded information distributing section 1104 receives frame loss information from frame loss information distributing section 1101. Then, second encoded information distributing section 1104 receives the quantized residual LSP from LSP decoding section 902, the second adaptive excitation lag from adaptive excitation codebook 905, the second quantized adaptive excitation gain and the second quantized fixed excitation gain from quantized gain generating section 906, and the second fixed excitation vector from fixed excitation codebook 907. Then, second encoded information distributing section 1104 outputs the quantized residual LSP, second adaptive excitation lag, second fixed excitation vector, second quantized adaptive excitation gain and second quantized fixed excitation gain to encoded information storage section 1103. If the frame loss information is "2", then second encoded information distributing section 1104 outputs the quantized residual LSP, second adaptive excitation lag, second quantized adaptive excitation gain and second quantized fixed excitation gain to first decoding section 153.

Encoded information storage section 1103 receives frame loss information from frame loss information distributing section 1101. Encoded information storage section 1103 is provided with a buffer inside to store the quantized residual LSP, second adaptive excitation lag, second fixed excitation vector, second quantized adaptive excitation gain, and second quantized fixed excitation gain in the preceding frame. If the frame loss information is "0" or "1", then encoded information storage section 1103 outputs the quantized residual LSP in the preceding frame to LSP decoding section 902, the second adaptive excitation lag in the preceding frame to adaptive excitation codebook 905, the second fixed excitation vector in the preceding frame to fixed excitation codebook 907, and the second quantized adaptive excitation gain in the preceding frame and the second quantized fixed excitation gain in the preceding frame to quantized gain generating section 906. Then, encoded information storage section 1103 receives the quantized residual LSP, second adaptive excitation lag, second fixed excitation vector, second quantized adaptive excitation gain and second quantized fixed excitation gain from second encoded information distributing section 1104. Then, encoded information storage section 1103 stores the quantized residual LSP, second adaptive excitation lag, second fixed excitation vector, second quantized adaptive excitation gain and second quantized fixed excitation gain into the buffer, thus updating the buffer. The thus stored quantized residual LSP, second adaptive excitation lag, second fixed excitation vector, second quantized adaptive excitation gain and second quantized fixed excitation gain are used for the next frame as the quantized residual LSP in the preceding frame, the second adaptive excitation lag in the preceding frame, the second fixed excitation vector in the preceding frame, the second quantized adaptive excitation gain in the preceding frame and the second quantized fixed excitation gain in the preceding frame.

FIG. 12 shows a table listing frame loss information and specific parameters to be used in decoding by first decoding section 153 and second decoding section 154, according to the frame loss information. The table also includes frame loss information values and associated states of first encoded information and second encoded information. In FIG. 12, "lsp" stands for the first quantized LSP; "p_lsp" stands for the first quantized LSP in the preceding frame; "lag" stands for the first adaptive excitation lag; "p_lag" stands for the first adaptive excitation lag in the preceding frame; "sc" stands for the first fixed excttation vector; "p_sc" stands for the first fixed excitation vector in the preceding frame; "ga" stands for the first quantized adaptive excitation gain, "p_ga" stands for the first quantized adaptive excitation gain in the preceding frame; "gs" stands for the first quantized fixed excitation gain; "p_gs" stands for the first quantized fixed excitation gain in the preceding frame; >"d_lsp" stands for the quantized residual LSP; "p_d_lsp" stands for the quantized residual LSP in the preceding frame; "d_lag" stands for the second adaptive excitation lag; "p_d_lag" stands for the second adaptive excitation lag in the preceding frame; "e_sc" stands for the second fixed excitation vector; "p_e_sc" stands for the second fixed excitation vector in the preceding frame; "e_ga" stands for the second quantized adaptive excitation gain; "p_e_ga" stands for the second quantized adaptive excitation gain in the preceding frame; "e_gs" stands for the second quantized fixed excitation gain; and "p_e_gs" stands for the second quantized fixed excitation gain in the preceding frame.

In FIG. 12, "received correctly" means a state where encoded information is received correctly and "loss" means a state where data is not received correctly (is lost).

When the frame loss information is "3", both first encoded information and second encoded information are received correctly; therefore, first decoding section 153 and second decoding section 154 decode the received first encoded information and second encoded information. In short, normal decoding without taking frame loss in account is executed.

When the frame loss information is "2", first encoded information is not received correctly; therefore, first decoding section 153 and second decoding section 154 perform decoding using first encoded information in the preceding frame instead of the first encoded information. Also, first decoding section 153 decodes using the second encoded information in addition to the first encoded information in the preceding frame, so as to improve decoded signal quality.

When the frame loss information is "1", second encoded information is not received correctly; therefore, second decoding section 154 performs decoding using second encoded information in the preceding frame instead of the second encoded information.

When the frame loss information is "0", both first encoded information and second encoded information are not received correctly; therefore, first decoding section 153 and second decoding section 154 perform decoding using first encoded information and second encoded information in the preceding frame instead of the first encoded information and the second encoded information.

Figure 13:
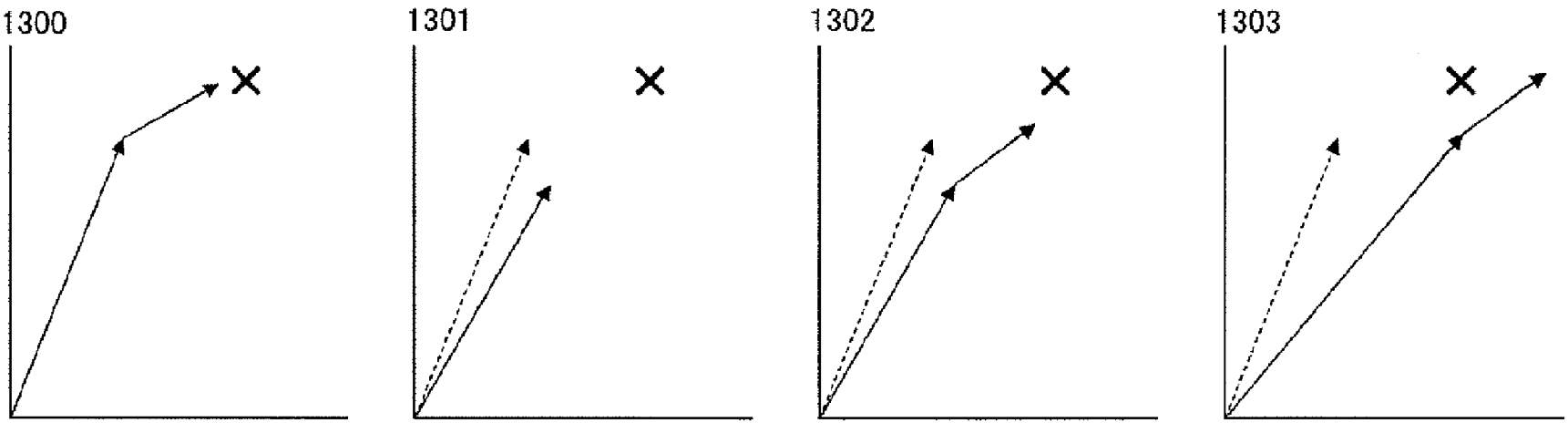
FIG. 13 visually explains a principle of improving quality by adding second encoded information.

FIG. 13 visually explains that decoded signal quality can be improved by the fact that, if first encoded information is not received correctly, first decoding section 153 performs decoding using second encoded information in addition to first encoded information in the preceding frame.

Here, a case will be described as an example where LSP decoding section 602 in first decoding section 153 obtains first quantized LSP. To simplify the explanation, the first quantized LSP is assumed as two-dimensional vectors.

In FIG. 13, a graph labeled with reference numeral 1300 is a pattern graph of first quantized LSP, quantized residual LSP and first LSP. Here, "x" indicates the first LSP, a long arrow indicates the first quantized LSP, and a short arrow indicates the quantized residual LSP. The first quantized LSP is included in first encoded information and the quantized residual LSP is included in second encoded information.

A graph labeled with reference numeral 1301 is a pattern graph of first quantized LSP, first quantized LSP in the preceding frame and first LSP. Here exit indicates the first LSP, a dotted arrow indicates the first quantized LSP, and a solid arrow indicates the first quantized LSP in the preceding frame. This represents a case where first encoded information (first quantized LSP) is not received correctly and LSP decoding section 802 obtains the first quantized LSP using only the first quantized LSP in the preceding frame (using the first quantized LSP in the preceding frame instead of the lost first quantized LSP).

A graph labeled with reference numeral 1302 is a pattern graph of first quantized LSP, first quantized LSP in the preceding frame, quantized residual LSP and first LSP. Here, "x" indicates the first LSP, a dotted arrow indicates the first quantized LSP, a long solid arrow indicates the first quantized LSP in the preceding frame, and a short solid arrow indicates the quantized residual LSP. This represents a case where first encoded information (first quantized LSP) is not received correctly and LSP decoding section 802 adds the first quantized LSP in the preceding frame and the quantized residual LSP, and obtains the first quantized LSP resulting from the addition.

If there is a high correlation between the first quantized LSP and the first quantized LSP in the preceding frame, i.e., their differential is small, the first quantized LSP that is obtained by a manner using the first quantized ESP in the preceding frame and the quantized residual LSP (1302) becomes closer to the first LSP ("x") than the first quantized LSP that is obtained by a manner using only the first quantized LSP in the preceding frame (1301).

However, if the correlation between the first quantized ISP and the first quantized LSP in the preceding frame is low, i.e., their differential is large, it is not always true that the first quantized LSP that is obtained by a manner using the first quantized LSP in the preceding frame and the quantized residual LSP becomes closer to the first LSD ("x") (1303). With regard to both the manner using only the first quantized LSP in the preceding frame and the manner using the first quantized LSP in the preceding frame and the quantized residual LSP, an experiment was conducted in which first quantized LSPs are actually obtained per frame by each manner and compared in terms of that the first quantized ESP obtained by which manner is closer to the first LSP. The result of the experiment using eight samples of speech signals with a duration of around a seconds showed that there are more frames in which the first quantized LSP obtained by the latter manner is closer to the first LSP for all eight samples. In particular, this tendency is noticeable in a speech period.

Although in this embodiment, a case has been described as an example where encoding apparatus 100 includes two encoding sections, the number of encoding sections is not so limited and may be three or more.

Although in this embodiment, a case has been described as an example where decoding apparatus 150 includes two decoding sections, the number of decoding sections is not so limited and may be three or more.

As illustrated in this embodiment, if the frame loss information is "0", first decoding section 153 performs decoding using only first encoded information in the preceding frame. However, the present invention is applicable to a case in which first decoding section 153 performs decoding using second encoded information in the preceding frame in addition to the first encoded information in the preceding frame, and the same effect and result as this embodiment can be achieved. In this case, the first decoded signal can be obtained in the same way in which first decoding section 153 performs decoding when the frame loss information is "2".

As illustrated in this embodiment, flag information is used to indicate whether or not second encoded information is included in encoded information that is used for decoding by first decoding section 153. However, the present invention may be applied to a case in which second encoded information is always included in encoded information that is used for decoding by first decoding section 153 and no flag information is used, and the same effect and result as this embodiment can be achieved.

As illustrated in this embodiment, first decoding section 153 and second decoding section 154 may produce decoded signals using encoded information in the preceding frame as encoded information in the current frame. However, decoded signals may be produced in such a way in which a driving excitation is obtained by multiplying the encoded information in the preceding frame with a given factor of attenuation, so that the driving excitation generated in the current frame is some what attenuated from the driving excitation generated in the preceding frame. If, for example, the frame loss information is "2", quantized gain generating section 806 multiples the obtained first quantized adaptive excitation gain (first quantized fixed excitation gain) by a given factor of attenuation (e.g., 0.9) and outputs the multiplication result as the first quantized adaptive excitation gain (first quantized fixed excitation gain), and thereby it is possible to attenuate the driving excitation generated in the current frame.

As illustrated in this embodiment, if the frame loss information is "2", quantized gain generating section 806 adds the first quantized adaptive excitation gain in the preceding frame (first quantized fixed excitation gain in the preceding frame) and the second quantized adaptive excitation gain (second quantized fixed excitation gain), multiples the addition result by 0.5, and supplies the multiplication result as the first quantized adaptive excitation gain (first quantized fixed excitation gain). However, the first quantized adaptive excitation gain (first quantized fixed excitation gain) may be obtained by adding the first quantized adaptive excitation gain in the preceding frame (first quantized fixed excitation gain in the preceding frame) and the second quantized adaptive excitation gain (second quantized fixed excitation gain) at a given ratio. For example, first quantized adaptive excitation gain (first quantized fixed excitation gain) b_gain can be obtained by equation (7).

$$b_gain = p_gain \times \beta + e_gain \times (1-\beta) \quad (7)$$

where, p_gain is the first quantized adaptive excitation gain in the preceding frame, e_gain is the second quantized adaptive excitation gain (second quantized fixed excitation gain), and P assumes any value from 0 to 1. The value of D can be set arbitrarily.

As illustrated in this embodiment, if the frame loss information is "1", quantized gain generating section 906 adds the first quantized adaptive excitation gain (first quantized fixed excitation gain) and the second quantized adaptive excitation gain in the preceding frame (second quantized fixed excitation gain in the preceding frame), multiples the addition result by 0.5, and supplies the multiplication result as the second quantized adaptive excitation gain (second quantized fixed excitation gain). However, the second quantized adaptive excitation gain (second quantized fixed excitation gain) may be obtained using the same method as above.

As illustrated in this embodiment, a case has been described as an example where decimal digits are used for frame loss information. However, the present invention may be applied to a case in which binary digits are used for frame loss information, and the same effect and result as this embodiment can be achieved. For example, to express the states of two encoded information (first and second encoded information) using binary digits, it is possible to use "1" to represent a state where data is received correctly and "0" to represent a state where data is not received correctly, and thereby frame loss information can be represented in two binary digits ("00" to "11").

As illustrated in this embodiment, a fixed excitation vector that is generated by fixed excitation codebook 208 is formed of pulses. However, the present invention may be applied to a case where spread pulses are used to form a fixed excitation vector, and the same effect and result as this embodiment can be achieved.

In this embodiments, a case has been described where the encoding sections and decoding sections performs encoding and decoding by the CELP type speech/sound encoding and decoding method. However, the present invention may be applied to cases where the encoding sections and decoding sections perform encoding and decoding by another speech/sound encoding and decoding method other than the CELP type (e.g., pulse code modulation, predictive coding, vector quantizing and vocoder), and the same effect and result as this embodiment can be achieved. The present invention may also be applied to a case in which the encoding sections and decoding sections use different speech/sound encoding and decoding methods, and the same effect and result as this embodiment can be achieved.

Embodiment 2

Figure 14A:
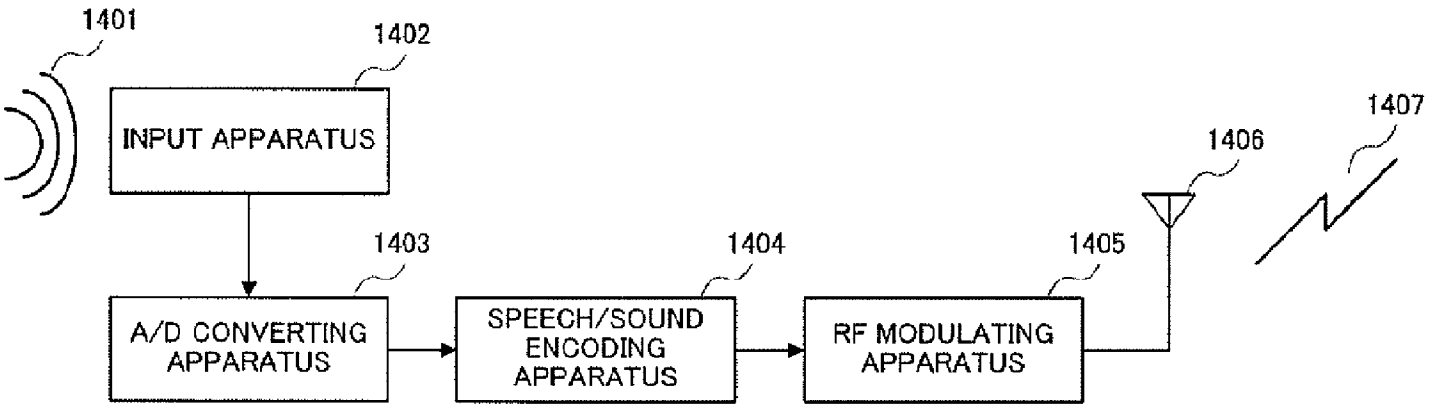
FIG. 14A is a block diagram showing a configuration of a speech/sound transmission apparatus according to a second embodiment of the present invention.

FIG. 14A is a block diagram showing a configuration of a speech/sound transmitting apparatus according to Embodiment 2 of the present invention, wherein the transmitting apparatus includes the encoding apparatus described in the above-described Embodiment 1.

Speech/sound signal 1401 is converted into an electric signal by input apparatus 1402 and the electric signal is outputted to A/D converting apparatus 1403. A/D converting apparatus 1403 converts the signal (analog) outputted from input apparatus 1402 into a digital signal and outputs the digital signal to speech/sound encoding apparatus 1404. Speech/sound encoding apparatus 1404 in which encoding apparatus 100 shown in FIG. 1 is implemented, encodes the digital speech/sound signal outputted from A/D converting apparatus 1403 and outputs encoded information to RF modulating apparatus 1405. RF modulating apparatus 1405 converts the encoded information outputted from speech/sound encoding apparatus 1404 into a signal for transmission on a transmission medium such as radio waves and outputs the transmission signal to transmitting antenna 1406. Transmitting antenna 1406 transmits the output signal outputted from RF modulating apparatus 1405 as a radio wave (RF signal). In the figure, RE signal 1407 represents the radio wave (RF signal) transmitted from transmitting antenna 1406.

The above outlines the configuration and operation of the speech/sound signal transmitting apparatus.

Figure 14B:
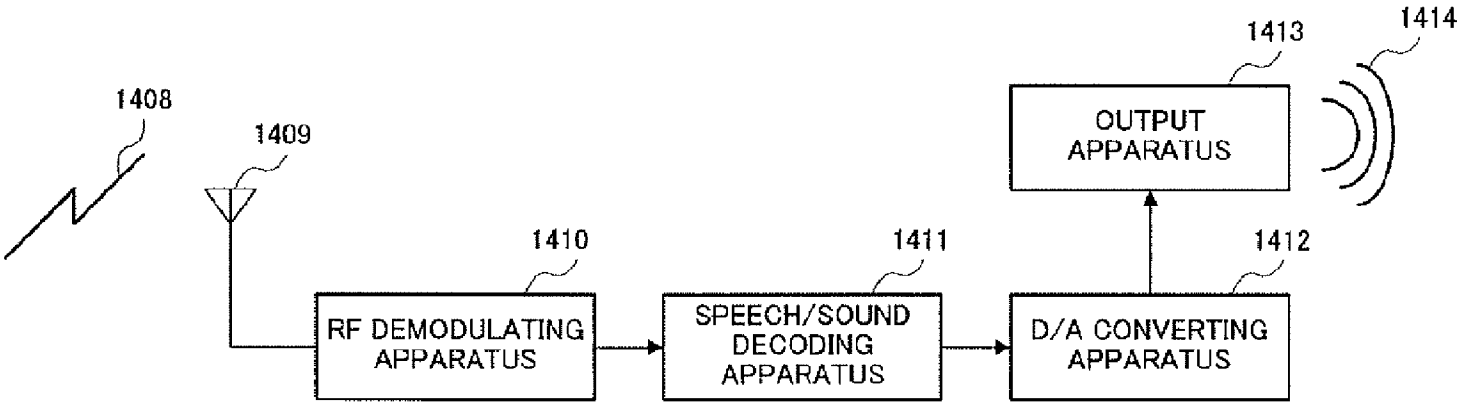
FIG. 14B is a block diagram showing a configuration of a speech/sound reception apparatus according to Embodiment 2 of the present invention.

FIG. 14B is a block diagram showing a configuration of a speech/sound receiving apparatus according to Embodiment 2 of the present invention, wherein the receiving apparatus includes the decoding apparatus described in the above-described Embodiment 1.

RF signal 1408 is received by receiving antenna 1409 and outputted to RF demodulating apparatus 1410. In the figure, RF signal 1408 represents the radio wave received by receiving antenna 1409 and is identical to RF signal 1407, unless the signal is attenuated or noise is superimposed on it in a transmission path.

RF demodulating apparatus 1410 demodulates the RF signal outputted from receiving antenna 1409 into encoded information and outputs the encoded information to speech/sound decoding apparatus 1411. Speech/sound decoding apparatus 1411 in which decoding apparatus 150 shown in FIG. 1 is implemented, decodes the encoded information outputted from RF demodulating apparatus 1410 and outputs a decoded signal to D/A converting apparatus 1412. D/A converting apparatus 1412 converts the digital speech/sound signal outputted from speech/sound decoding apparatus 1411 into an analog electric signal and outputs this signal to output apparatus 1413. Output apparatus 1413 converts the electric signal into air vibration and outputs it as acoustic waves that can be heard by human ears. In the figure, reference numeral 1414 indicates outputted acoustic waves.

The above outlines the configuration and operation of the speech/sound receiving apparatus.

By providing the above speech/sound signal transmitting apparatus and speech/sound signal receiving apparatus in a base station apparatus and a communication terminal apparatus in a wireless communication system, high quality output signals can be obtained.

As described above, according to this embodiment, the encoding apparatus and the decoding apparatus according to the present invention can be implemented in the speech/sound signal transmitting apparatus and the speech/sound signal receiving apparatus.

The encoding apparatus and the decoding apparatus according to the present invention are not limited to the above-described Embodiments 1 and 2 and can be changed and implemented in various ways.

It is possible to install the encoding apparatus and the decoding apparatus according to the present invention in a mobile terminal apparatus and a base station apparatus in a mobile communication system and provide a mobile terminal apparatus and a base station apparatus having the same effect and result as described above.

Although a case has been described as an example where the present invention is implemented with hardware. However, the present invention may be realized by software.

The present application is based on Japanese Patent Application No. 2004-153997 filed on May 24, 2004, the entire content of which is incorporated herein by reference.

INDUSTRIAL APPLICABILITY

The encoding apparatus and the decoding apparatus according to the present invention have an advantageous effect of obtaining decoded speech signals with good quality even if encoded information is lost, and are useful as a speech/sound encoding apparatus, a speech/sound decoding method, and the like for use in a communication system where speech/sound signals are encoded and transmitted.

The invention claimed is:

1. A speech/sound decoding apparatus that generates decoded signals by decoding encoded information configured in a plurality of layers including a first layer and a second layer, the speech/sound decoding apparatus comprising:

a frame loss detector that determines whether or not encoded information related to the first layer and encoded information related to the second layer in a received frame are each correct, and generates frame loss information comprising a result of the determination;

a first decoder that determines encoded information to use for decoding of the first layer, according to the frame loss information, from one of first encoded information received in a present frame and first encoded information received in a previous frame, and one of second encoded information received in the present frame and second encoded information received in the previous frame, and generates a first decoded signal by performing decoding using the determined encoded information, determined by the first decoder; and a second decoder that determines encoded information to use for decoding of the second layer, according to the frame loss information, from one of the first encoded information received in the present frame and the first encoded information received in the previous frame, and one of the second encoded information received in the present frame and the second encoded information received in the previous frame, and generates a second decoded signal by performing decoding using the determined encoded information, determined by the second decoder, wherein the first decoder and the second decoder perform decoding using encoded information specified by one of a designated combination of a plurality of specific combinations of encoded information, which is based on a specific value of the frame loss information, the plurality of specific combinations of encoded information including: a first combination of first encoded information in the current frame and second encoded information in the current frame, a second combination of first encoded information in the preceding frame and second encoded information of the current frame, a third combination of first encoded information in the current frame and second encoded information in the preceding frame, and a fourth combination of the first encoded information in the preceding frame and second encoded information in the preceding frame, wherein the first encoded information comprises LSP, adaptive codebook excitation lag, fixed codebook excitation vector, adaptive and fixed excitation gains, and the second encoded information consists of delta adaptive LSP, delta adaptive codebook excitation lag, fixed codebook excitation vector, and adaptive and fixed excitation gains.

2. The speech/sound decoding apparatus according to claim 1, wherein, when the first encoded information is not received correctly in the present frame, the first decoder performs decoding using only the first encoded information received in the previous frame, or the first encoded information received in the previous frame and the correctly received second encoded information in the present frame, based on the value of the frame loss information.

3. The speech/sound decoding apparatus according to claim 1, wherein, when a value of the frame loss information shows that the first encoded information is not received correctly in the present frame and the second encoded information is received correctly in the present frame, the first decoder receives as input the correctly received second encoded information from the second decoder and performs decoding using the first encoded information received in the previous frame and the correctly received second encoded information in the present frame, and the second decoder receives the first encoded information received in the previous frame from the first decoder, and performs decoding using the first encoded information received in the previous frame and the correctly received second encoded information in the present frame.

4. A base station apparatus, comprising the speech/sound decoding apparatus of claim 1.

5. A communication terminal apparatus, comprising the speech/sound decoding apparatus of claim 1.

6. A speech/sound decoding method of generating decoded signals by decoding encoded information configured in a plurality of layers including a first layer and a second layer, the speech/sound decoding method comprising:

determining, by a frame loss detector, whether or not encoded information related to the first layer and encoded information related to the second layer in a received frame are each correct, and generating frame loss information comprising a result of the determination;

determining, by a first decoder, encoded information to use for decoding of the first layer, according to the frame loss information, from one of first encoded information received in a present frame and first encoded information received in a previous frame, and one of the second encoded information received in the present frame and the second encoded information received in the previous frame, and generating a first decoded signal by performing decoding using the determined encoded information, determined by the first decoder;

and determining, by a second decoder, encoded information to use for decoding of the second layer, according to the frame loss information, from one of the first encoded information received in the present frame and the first encoded information received in the previous frame, and one of second encoded information received in the present frame and second encoded information received in the previous frame, and generating a second decoded signal by performing decoding using the determined encoded information, determined by the second decoder, wherein, in determining encoded information to use for decoding of the first layer and for decoding of the second layer, decoding is performed using encoded information specified by one of a designated combination of a plurality of specific combinations of encoded information, which is based on a specific value of the frame loss information, the plurality of specific combinations of encoded information including: a first combination of first encoded information in the current frame and second encoded information in the current frame, a second combination of first encoded information in the preceding frame and second encoded information of the current frame, a third combination of first encoded information in the current frame and second encoded information in the preceding frame, and a fourth combination of the first encoded information in the preceding frame and second encoded information in the preceding frame, wherein the first encoded information comprises LSP, adaptive codebook excitation lag, fixed codebook excitation vector, adaptive and fixed excitation gains, and the second encoded information consists of delta adaptive LSP, delta adaptive codebook excitation lag, fixed codebook excitation vector, and adaptive and fixed excitation gains.

* * * * *